US008944887B2

(12) United States Patent
Trojan et al.

(10) Patent No.: US 8,944,887 B2
(45) Date of Patent: Feb. 3, 2015

(54) APPARATUS AND METHOD FOR SURFACE GRINDING AND EDGE TRIMMING WORKPIECES

(75) Inventors: Daniel R. Trojan, Phoenix, AZ (US); Richard Ciszek, Phoenix, AZ (US); Clifford Daniel, Tempe, AZ (US)

(73) Assignee: Axus Technology, LLC, Chandler, AZ (US)

( * ) Notice: Subject to any disclaimer, the term of this patent is extended or adjusted under 35 U.S.C. 154(b) by 791 days.

(21) Appl. No.: 13/208,815

(22) Filed: Aug. 12, 2011

(65) Prior Publication Data

US 2012/0202406 A1 Aug. 9, 2012

Related U.S. Application Data

(60) Provisional application No. 61/440,920, filed on Feb. 9, 2011.

(51) Int. Cl.
*B24B 37/00* (2012.01)

(52) U.S. Cl.
USPC ..... 451/41; 451/11; 451/44; 451/57; 451/65; 451/285; 451/287

(58) Field of Classification Search
USPC ..... 451/9, 10, 11, 41, 44, 63, 65, 66, 57, 6, 451/285, 287, 290, 413
See application file for complete search history.

(56) References Cited

U.S. PATENT DOCUMENTS

| | | | | |
|---|---|---|---|---|
| 6,062,954 | A * | 5/2000 | Izumi | 451/72 |
| 6,685,542 | B2 * | 2/2004 | Mori et al. | 451/65 |
| 7,063,604 | B2 | 6/2006 | Spiegel | |
| 7,118,446 | B2 | 10/2006 | Walsh et al. | |
| 7,249,992 | B2 * | 7/2007 | Kalenian et al. | 451/11 |
| 7,458,878 | B2 | 12/2008 | Walsh et al. | |
| 7,559,823 | B2 * | 7/2009 | Sato et al. | 451/5 |
| 2005/0176350 | A1 * | 8/2005 | Gerber | 451/11 |
| 2006/0111021 | A1 * | 5/2006 | Gerber | 451/11 |
| 2006/0264156 | A1 * | 11/2006 | Jeong | 451/11 |
| 2008/0038992 | A1 * | 2/2008 | Jeong | 451/11 |
| 2008/0274673 | A1 * | 11/2008 | Adachi | 451/57 |
| 2010/0035526 | A1 * | 2/2010 | Tolles et al. | 451/57 |

* cited by examiner

*Primary Examiner* — Eileen P. Morgan
(74) *Attorney, Agent, or Firm* — Schmeiser, Olsen & Watts LLP; Lowell W. Gresham

(57) ABSTRACT

An apparatus for performing both edge trimming and surface grinding includes two spindles for holding two workpieces, a bridge element laterally movable relative to the spindles, and two grinding wheels coupled to the bridge element. The apparatus may be a surface grinding apparatus that includes a system for enabling the surface grinding apparatus to additionally perform edge trimming. A method for processing the workpieces entails placing the two workpieces on the two spindles of the apparatus, directing the bridge element to move laterally to an edge trimming position to trim the outer edge of one workpiece using one of the grinding wheels, to move laterally to another edge trimming position to trim the outer edge of the other workpiece using one of the grinding wheels, and to move laterally to surface grinding positions to perform surface grinding on both of the workpieces using one or both of the grinding wheels.

20 Claims, 17 Drawing Sheets

PRIOR ART

PRIOR ART 242 244 246

OFFSET DISTANCE (D) = $\sqrt{\text{HYPOTENUSE (H) - SIDE OPPOSITE (O)}}$

FOR: GRINDING WHEEL DIAMETER (G) = 11.094 INCHES 248
WORKPIECE DIAMETER (W) = 7.874 INCHES 250
EDGE TRIM DISTANCE (TD) = 0.276 INCHES 252
O = 5.25 INCHES 246

H = 1/2(G) + 1/2(W) - TD
= 9.208 INCHES 244

THEREFORE: OFFSET DISANCE (D) = 5.565 INCHES 242

FIG. 16

| | 270 SURFACE GRINDING | | 278 | 276 | 274 |
|---|---|---|---|---|---|
| | LEFT GRIND WHEEL | RIGHT GRIND WHEEL | LEFT | CENTER | RIGHT |
| 64 | COARSE GRIND, RIGHT SPINDLE | IDLE | - | - | 0.03 |
| 66 | COARSE GRIND, LEFT SPINDLE | FINE GRIND, RIGHT SPINDLE | - | 15.80 | - |
| 68 | IDLE | FINE GRIND, LEFT SPINDLE | 31.63 | - | - |
| | 272 EDGE TRIMMING | | | | |
| 256 | IDLE | EDGE TRIM, RIGHT SPINDLE | 31.63 | 22.10 | 0.03 |
| 258 | IDLE | EDGE TRIM, LEFT SPINDLE | 23.00 | 15.80 | 0.03 |
| 264 | EDGE TRIM, RIGHT SPINDLE | IDLE | 25.30 | 10.0 | 6.30 |
| 266 | EDGE TRIM, LEFT SPINDLE | IDLE | 31.63 | 7.20 | 0.03 |

268

FIG. 17

| STATE | SENSOR (238: LEFT; 236: RIGHT) | | | | | |
|---|---|---|---|---|---|---|
| | LEFT | | CENTER | RIGHT | | |
| | 126 | 124 | 122 | 120 | 118 | |
| NOT EDGE TRIMMING | - | - | OFF | - | - | 282 |
| NOT EDGE TRIMMING | - | OFF | ON | ON | ON | 284 |
| NOT EDGE TRIMMING | ON | ON | ON | OFF | - | 286 |
| EDGE TRIMMING, LEFT GRIND WHEEL | OFF | ON | ON | OFF | OFF | 288 |
| EDGE TRIMMING, RIGHT GRIND WHEEL | OFF | OFF | ON | ON | OFF | 290 |
| | 206 | 204 | 202 | 200 | 198 | |

280

FIG. 18

| | SENSOR (238) | | | SENSOR (236) | | SEAL FLAP POSTION | RIGHT SEAL FLAP CONTROL | | LEFT SEAL FLAP CONTROL | |
|---|---|---|---|---|---|---|---|---|---|---|
| | LEFT | | CENTER | RIGHT | | | | | | |
| | 126 | 124 | 122 | 120 | 118 | | 208 | 210 | 214 | 216 |
| 294 | - | - | - | OFF | OFF | LOWER RIGHT SEAL FLAP | OFF | ON | - | - |
| 296 | - | - | - | - | ON | RAISE RIGHT SEAL FLAP | ON | OFF | - | - |
| 298 | - | - | - | ON | - | | | | | |
| 300 | OFF | OFF | - | - | - | LOWER LEFT SEAL FLAP | - | - | OFF | ON |
| 302 | - | ON | - | - | - | RAISE LEFT SEAL FLAP | - | - | ON | OFF |
| 304 | ON | - | - | - | - | | | | | |
| | 206 | 204 | 202 | 200 | 198 | | | | | |

290

FIG. 19

| | EDGE TRIMMING STATE | GRIND SEAL SIGNALS FROM PRIMARY CONTROL SYSTEM | | OVERRIDE SIGNALS FROM EDGE TRIMMING CONTROLLER | | GRIND SEAL CONDITION |
|---|---|---|---|---|---|---|
| | | RIGHT (220) | LEFT (226) | RIGHT (224) | LEFT (230) | |
| 308 | NO | - | - | OFF | OFF | 310 - |
| 312 | YES | OFF | OFF | OFF | OFF 314 | BOTH GRIND SEALS, DEFLATE |
| 316 | YES | ON | OFF | OFF | ON 318 | BOTH GRIND SEALS, INFLATE |
| 320 | YES | OFF | ON | ON | OFF 322 | BOTH GRIND SEALS, INFLATE |
| 324 | YES | ON | ON | OFF | OFF 326 | BOTH GRIND SEALS, INFLATE |
| | | 220 | 226 | 224 | 230 | |

306

APPARATUS AND METHOD FOR SURFACE GRINDING AND EDGE TRIMMING WORKPIECES

RELATED INVENTION

The present invention claims priority under 35 U.S.C. §119 (e) to: "Method and Apparatus for Wafer Backgrinding and Edge Trimming on One Machine," U.S. Provisional Patent Application Ser. No. 61/440,920, filed 9 Feb. 2011, which is incorporated by reference herein.

TECHNICAL FIELD OF THE INVENTION

The present invention relates to the field of wafer processing. More specifically, the present invention relates to an apparatus and method for surface grinding and edge trimming workpieces on a single machine.

BACKGROUND OF THE INVENTION

Semiconductor device fabrication is the process used to create integrated circuits present in everyday electrical and electronic devices. In general, semiconductor device fabrication is a multiple-step sequence of photographic and chemical processing steps during which electronic circuits are gradually created on a wafer made of semiconducting material. Virtually every step of semiconductor device fabrication is continually evolving in an effort to obtain increased efficiencies and cost savings.

Surface grinding or polishing operations in semiconductor device fabrication can entail back grinding and face grinding. Wafer back grinding is a process in semiconductor device fabrication in which the backside of a wafer is ground to the correct wafer thickness prior to assembly. It is also referred to as "wafer thinning." Wafer back grinding is indispensable to meet dimensional requirements of decreasing semiconductor thinness. Wafer face grinding is a process in semiconductor device fabrication in which the front or active surface of the wafer is planarized, or flattened, after each layer is formed on the substrate in order to meet exceedingly stringent flatness requirements necessary for small-dimensioned patterning. Back grinding and face grinding operations, collectively referred to herein as surface grinding, have been implemented in various forms on existing machines.

Referring to FIGS. 1 and 2, FIG. 1 shows a partial perspective view of a prior art surface grinding apparatus 20, and FIG. 2 shows an illustration of a partial top view of surface grinding apparatus 20. Surface grinding apparatus 20 may be utilized to perform back grinding and/or face grinding on workpieces such as semiconductor and high-precision wafers and substrates including, for example, silicon, gallium arsenide, silicon carbide, sapphire, quartz, fused silica, glass, layered silicon-insulator-silicon substrate, and so forth.

Surface grinding apparatus 20 is adapted to concurrently process two workpieces. Accordingly, surface grinding apparatus 20 includes a first (i.e., right) grind chamber 22 and a second (i.e., left) grind chamber 24 located in a cabinet 26 of apparatus 20. A first (i.e., right) spindle 28 is positioned in first grind chamber 22, and a second (i.e., left) spindle 30 (visible in FIG. 2) is positioned in second grind chamber 24. Each of first and second spindles 28 and 30, respectively, is capable of holding a workpiece while performing surface grinding. First and second spindles 28 and 30 may also be referred to as wafer spindles, wafer chucks, or simply chucks.

A mounting plate 32 is coupled to a top surface of cabinet 26. Mounting plate 32 includes a first opening 34 and a second opening 36 (visible in FIG. 2). A first mounting section 38 in mounting plate 32 encircles first opening 34. Likewise, a second mounting section 40 in mounting plate 32 encircles second opening 36. A first grind seal 42 resides in first mounting section 38 and a second grind seal 44 resides in second mounting section 40. Each of first and second grind seals 42 and 44, respectively, is formed as a continuous ring that is substantially oval in shape so as to fit in their corresponding first and second mounting sections 38 and 40.

Surface grind apparatus 20 further includes a first grinding wheel 46 and a second grinding wheel 48, represented in FIG. 2. First and second grinding wheels 46 and 48 extend through a sealing plate 50 and may be vertically adjusted to reside in either of first and second grind chambers 22 and 24, respectively. Coolant nozzles 52 (of which only one is visible) are positioned in each of first and second grind chambers 22 and 24 to direct water onto first and second grinding wheels 46 and 48 and workpieces (not shown) on first and second spindles 28 and 30 during grinding.

Each of first and second grinding wheels 46 and 48, respectively, is attached to a separate grind spindle 54, of which only one is visible in FIG. 1, and grind spindles 54 are coupled to a bridge element 56. In general, corresponding rotational axes of first and second grinding wheels 46 and 48 are laterally displaced (i.e., separated) from one another by a fixed distance 58, e.g., fifteen inches. Likewise, corresponding centers of first and second spindles 28 and 30 are laterally displaced (i.e., separated) from one another by a fixed distance 60, e.g., fifteen inches. However, bridge element 56 controls the linear position, or translation, of first grinding wheel 46, second grinding wheel 48, and sealing plate 50 relative to first and second spindles 28 and 30, respectively. Accordingly, first grinding wheel 46, second grinding wheel 48, and sealing plate 50 can be directed to move laterally relative to first and second spindles 28 and 30 to suitable positions (discussed below) for surface grinding operations.

First and second grind seals 42 and 44 are inflatable seals. Accordingly, first and second grind seals 42 and 44 can be deflated to enable unencumbered movement of sealing plate 50 as sealing plate 50 moves across mounting plate 32. However, when sealing plate 50 is moved into a grinding position covering one or both of first and second grind chambers 22 and 24, one or both of first and second grind seals 42 and 44 are inflated in order to contain water and effluent while grinding.

FIG. 3 shows a chart 62 representing surface grinding positions in which the prior art surface grinding apparatus 20 (FIG. 1) can be placed. In particular, FIG. 3 shows a position of first and second grinding wheels 46 and 48, respectively, relative to first and second spindles 28 and 30, respectively. The surface grinding positions include a first, e.g., right, surface grinding position 64, a second, e.g., center, surface grinding position 66, and a third, e.g., left surface grinding position 68. In this example, the surface grinding positions are referenced from first grinding position 64. That is, bridge element 56 (FIG. 1) is "homed" by translating bridge element 56 the full distance to a right side limit switch, then bridge element 56 is translated leftward to first grinding position 64, which is considered "home." Second and third surface grinding positions 66 and 68, respectively, are defined as a distance from first surface grinding position 64 (e.g., 15.8 inches and 31.63 inches, respectively) as shown in chart 62.

Surface grinding apparatus 20 may be configured to perform a two-step grinding process. In an example, surface grinding apparatus 20 may be capable of carrying out coarse and fine grinding on a first workpiece 70 and a second workpiece 72. To that end, first grinding wheel 46 may be a fine grinding wheel, as demarcated by "FINE," and second grinding wheel 48 may be a coarse grinding wheel, as demarcated by "COARSE." First and second workpieces 70 and 72 are represented in FIG. 3 by shading in order to distinguish them from the underlying first and second spindles 28 and 30, respectively. Additionally, although the portion of each of spindles 28 and 30 underlying first and second grinding wheels 46 and 48 is represented in ghost form by dashed lines, the portion of each of first and second workpieces 70 and 72, respectively, underlying first and second grinding wheels 46 an 48 is not shown for simplicity of illustration.

A two-step grinding process may entail placing first workpiece 70 on first spindle 28 and placing second workpiece 72 on second spindle 30. Of course, placement of first and second workpieces 70 and 72 on first and second spindles 28 and 30 can be performed through automated placement by a robot apparatus (not shown) and first and second workpieces 70 and 72 may be retained on first and spindles 28 and 30 by conventional means so they do not slip or otherwise move. A sequence of grinding operations can include adjusting first and second grinding wheels 46 and 48 to first surface grinding position 64 so that first grinding wheel 46 is idle and second grinding wheel 48 performs coarse grinding on the surface of first workpiece 70. Next, first and second grinding wheels 46 and 48 can be adjusted to second surface grinding position 66 so first grinding wheel 46 performs fine grinding on first workpiece 70 and second grinding wheel 48 concurrently performs coarse grinding on second workpiece 72. Finally, first and second grinding wheels 46 and 48 can be adjusted to third surface grinding position 68 so first grinding wheel 46 performs fine grinding on second workpiece 72 and second grinding wheel 48 is idle. In any of grinding positions 64, 66, and 68, either or both of first and second grinding wheels, and either or both of first and second spindles will rotate during surface grinding.

Surface grinding apparatus 20 may achieve increased efficiency of grinding over devices with single grind wheels and single grind chucks. However, an even greater increase in wafer conditioning efficiency can lower the cost of semiconductor devices through decreases in manufacturing costs and equipment costs.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 16 shows a table summarizing values that may be entered via a user interface of the apparatus of FIG. 8 to achieve multiple surface grinding positions and edge trimming positions;

FIG. 17 shows a table summarizing proximity sensor states used to sense when the apparatus of FIG. 8 is being used for edge trimming operations;

FIG. 18 shows a table relating proximity sensor states with seal flap position and control in the apparatus of FIG. 8;

FIG. 19 shows a table of grind seal conditions relative to edge trimming states in the apparatus of FIG. 8.

DETAILED DESCRIPTION

Increasingly, wafer processing for semiconductor device fabrication entails the incorporation of wafer edge trimming operations. As wafers become thinner, conventional thinning processes put wafer edges at high risk of chipping. In particular, a conventional surface grinding process can produce a wafer in which its edge becomes a protruding and unsupported sharp edge of, for example, silicon, with increased likelihood of chipping.

Figure 4:
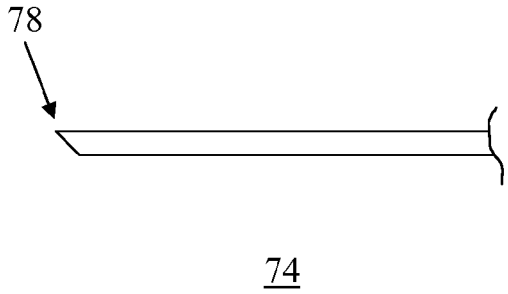
FIG. 4 shows a partial side view of a wafer that has undergone surface grinding without undergoing an edge trimming process.
Figure 5:
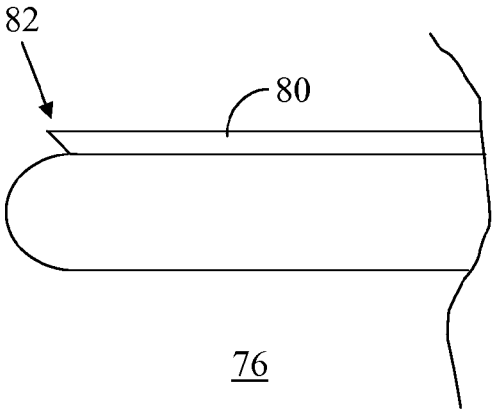
FIG. 5 shows a partial side view of a bonded wafer pair that has undergone surface grinding without undergoing an edge trimming process.

Referring to FIGS. 4 and 5, FIG. 4 shows a partial side view of a wafer 74 that has undergone surface grinding without performing an edge trimming process, and FIG. 5 shows a partial side view of a bonded wafer pair 76 that has undergone surface grinding without performing an edge trimming process. As shown in FIG. 4, when a single wafer 74 undergoes surface grinding without edge trimming, an undesirably sharp and fragile edge 78 may be created. Similarly, as shown in FIG. 5, when a top wafer 80 of bonded wafer pair undergoes surface grinding without trimming an edge of top wafer 80, an undesirable delicate, sharp, and fragile edge 82 may be created. Chipping, cracking, and other deformations can occur along either of these fragile edges 78 and 82.

Figure 6:
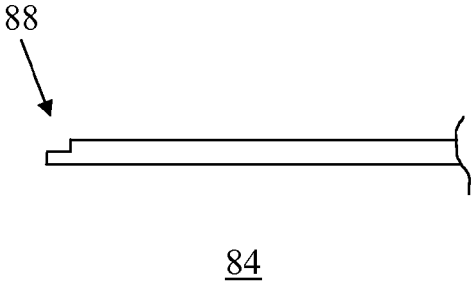
FIG. 6 shows a partial side view of a wafer that has undergone edge trimming.
Figure 7:
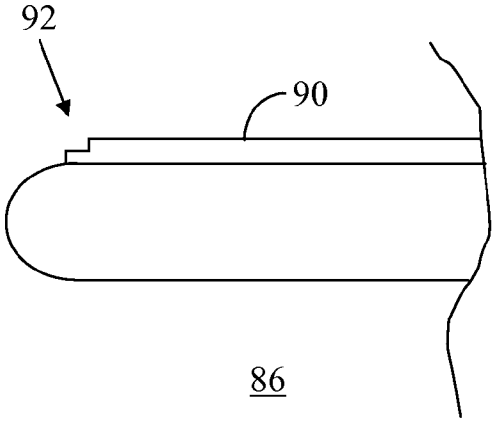
FIG. 7 shows a partial side view of a bonded wafer pair that has undergone edge trimming.

Referring now to FIGS. 6 and 7, FIG. 6 shows a partial side view of a wafer 84 that has undergone edge trimming, and FIG. 7 shows a partial side view of a bonded wager pair 86 that has undergone edge trimming. As shown FIG. 6, when the edge of wager 84 is trimmed before surface grinding, a desirable stepped edge 88 is produced. Similarly, when the edge of a top wafer 90 of a bonded wafer pair 86 is trimmed prior to surface grinding, a more robust top wafer 90 is formed with a stepped edge 92. Stepped edges 88 and 92 are generally more resistant to breaking and chipping than edges 78 and 82. Thus, chipping along sharp edges may be reduced by trimming the edge of the wafer prior to surface grinding operations in order to remove rough or damaged surfaces from the edge region of a wafer. The benefits of performing an edge trimming process include a reduction in wager deflects, enable direct wafer bonding, and so forth.

Referring now to FIGS. 6 and 7, FIG. 6 shows a partial side view of a wafer 84 that has undergone edge trimming, and FIG. 7 shows a partial side view of a bonded wafer pair 86 that has undergone edge trimming. As shown in FIG. 6, when the edge of wafer. 84 is trimmed before surface grinding, a desirable stepped edge 88 is produced. Similarly, when the edge of a top wafer 90 of bonded wafer pair 86 is trimmed prior to surface grinding, a more robust top wafer 90 is formed with a stepped edge 92. Stepped edges 88 and 92 are generally more resistant to breaking and chipping than edges 78 and 82. Thus, chipping along sharp edges may be reduced by trimming the edge of the wafer prior to surface grinding operations in order to remove rough or damaged surfaces from the edge region of a wafer. The benefits of performing an edge trimming process include a reduction in wafer defects, enable direct wafer bonding, and so forth.

Typically, surface grinding and edge trimming calls for two separate machines, a surface grinder and a wafer edge grinder, which undesirably increases capital equipment costs, uses excessive space, and increases manufacturing complexity through incorporation of additional process steps.

An embodiment disclosed herein entails an apparatus for concurrently processing two workpieces (i.e., wafers), in which the apparatus can perform both surface grinding and edge trimming operations. Another embodiment entails a system for enabling a surface grinding apparatus to perform edge trimming, and still another embodiment entails a method for concurrently processing two workpieces using a surface grinding apparatus adapted to additionally perform edge trimming. Advantages of the disclosed embodiments include lower capital equipment costs, less manufacturing facility space requirements, fewer process consumables, and so forth.

Figure 8:
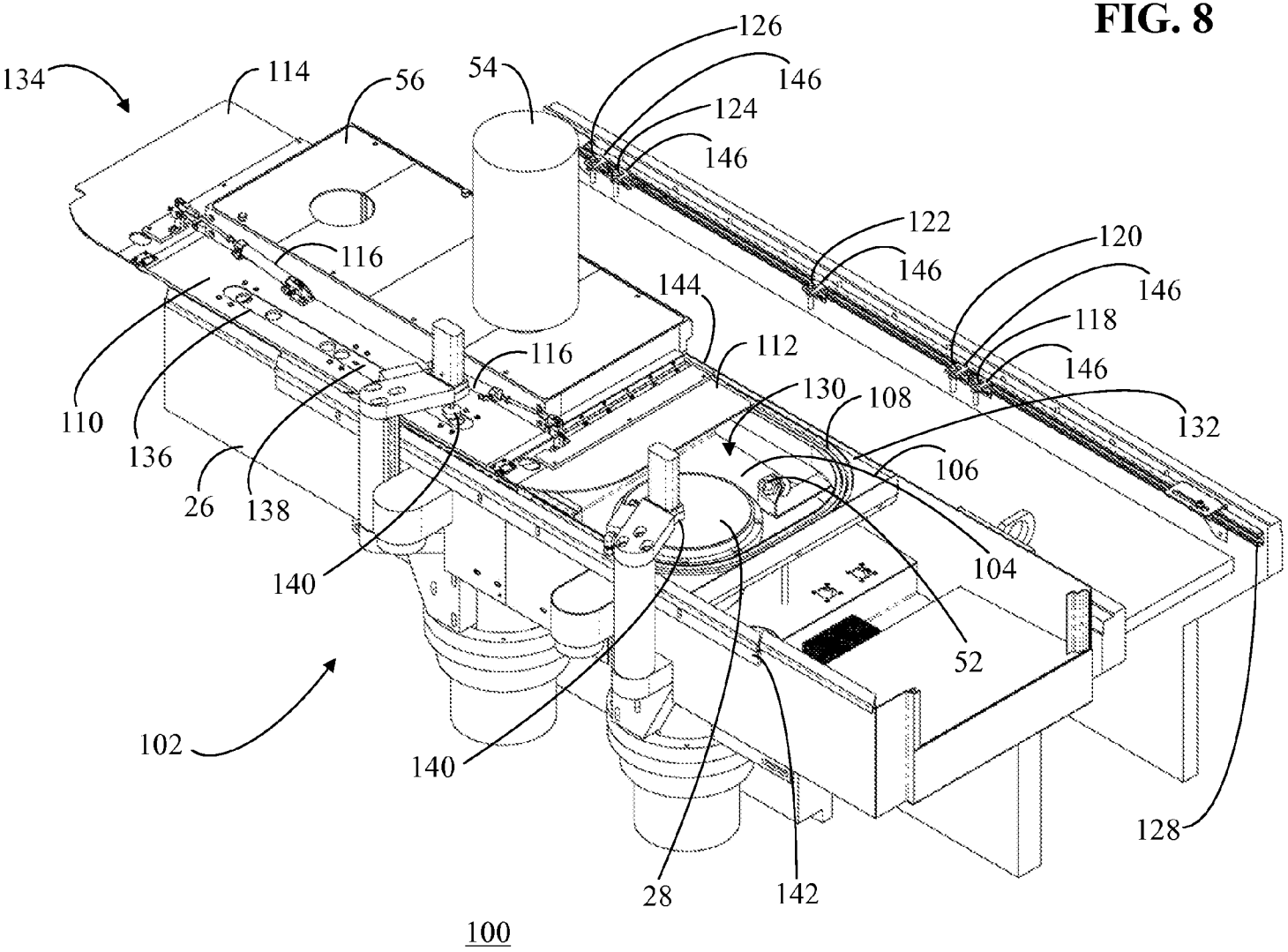
FIG. 8 shows a partial perspective view of an apparatus for processing workpieces in accordance with an embodiment.
Figure 9:
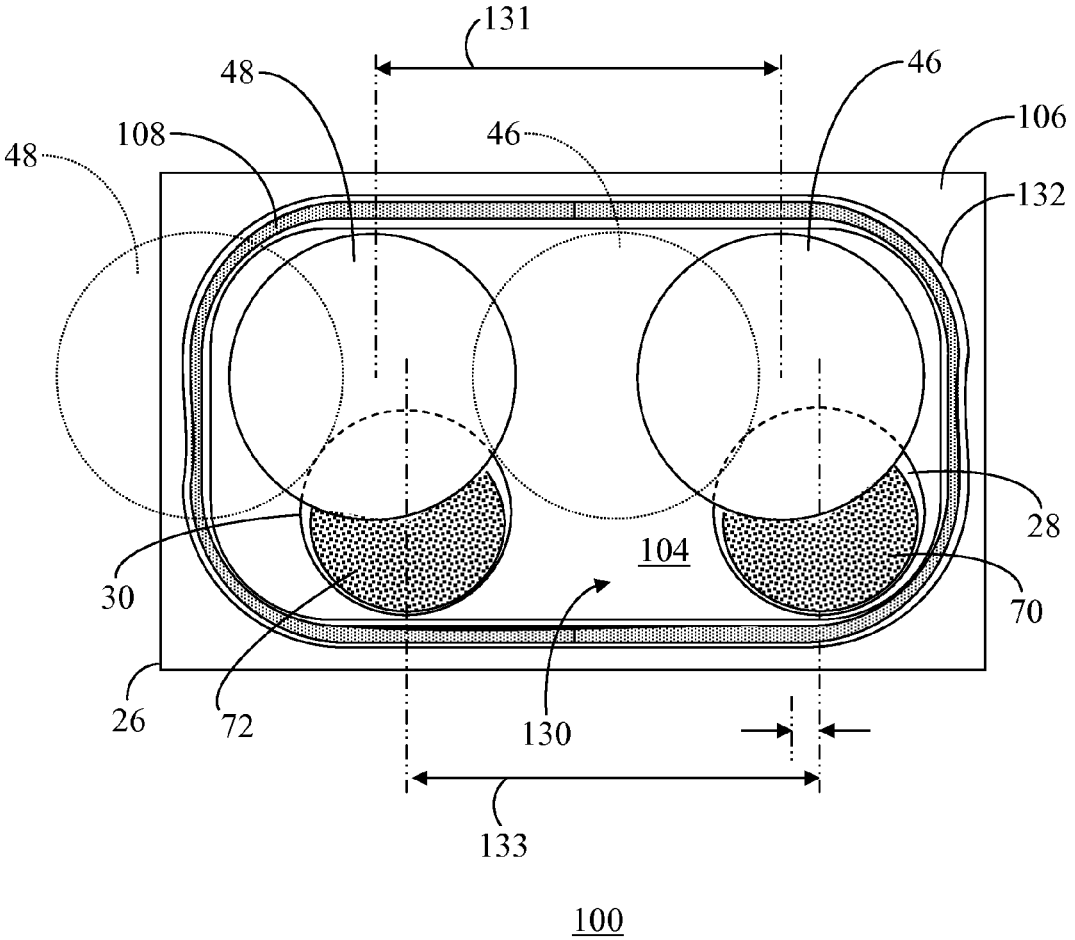
FIG. 9 shows an illustration of a partial top view of the apparatus of FIG. 8.

Referring to FIGS. 8 and 9, FIG. 8 shows a partial perspective view of an apparatus 100 for processing workpieces in accordance with an embodiment, and FIG. 9 shows an illustration of a partial top view of apparatus 100. Apparatus 100 is capable of performing both surface grinding and edge trimming on a pair of workpieces (e.g., first workpiece 70 and second workpiece 92). The terms "workpiece," "first workpiece," "second workpiece," and the like refer to existing and upcoming semiconductor and high-precision wafers and substrates including, for example, silicon, gallium arsenide, silicon carbide, sapphire, quartz, fused silica, glass, layered silicon-insulator-silicon substrate, and so forth.

In an embodiment, apparatus 100 is substantially surface grinding apparatus 20 (FIG. 1) which has been adapted to additionally perform edge trimming. Accordingly, the features and elements implemented to adapt surface grinding apparatus 20 to perform both surface grinding and edge trimming are collectively referred to herein as a system 102 for enabling a surface grinding apparatus to additionally perform edge trimming. The elements and features of surface grinding apparatus 20 (FIG. 1) that are largely unmodified retain their original reference numerals in the ensuing description, and elements and features that form system 102 will be identified as such herein.

Although apparatus 100 is discussed as being modified from a pre-existing surface grinding apparatus, such as apparatus 20 (FIG. 1), it should be understood that apparatus 100 need not be a modification of an existing device, but could instead be an original design that includes the combined features of surface grinding and edge trimming in an apparatus capable of concurrently conditioning two workpieces.

Apparatus 100 includes cabinet 26 in which first (i.e., right) spindle 28 and second (i.e., left) spindle 30 are located. First spindle 28 is configured to hold first workpiece 70 and second spindle 30 is configured to hold second workpiece 72. Apparatus 100 further includes bridge element 56 which is laterally movable relative to first and second spindles 28 and 30, respectively, and apparatus 100 additionally includes first and second grinding wheels 46 and 48, respectively, coupled to bridge element 56, where first and second grinding wheels 46 and 48 are laterally immovable relative to one another.

In the ensuing discussion in connection with the components of apparatus 100, the term "right" is used in lieu of the term "first" and the term "left" is used in lieu of the term "second," The right and left nomenclature corresponds with the orientation of the components in each of FIGS. 8 and 9. Accordingly, first spindle 28 is referred to hereinafter as right spindle 28, second spindle 30 is referred to hereinafter as left spindle 30, first grinding wheel 46 is referred to hereinafter as right grinding wheel 46, second grinding wheel 48 is referred to hereinafter as left grinding wheel 48, and so forth.

Figure 1:
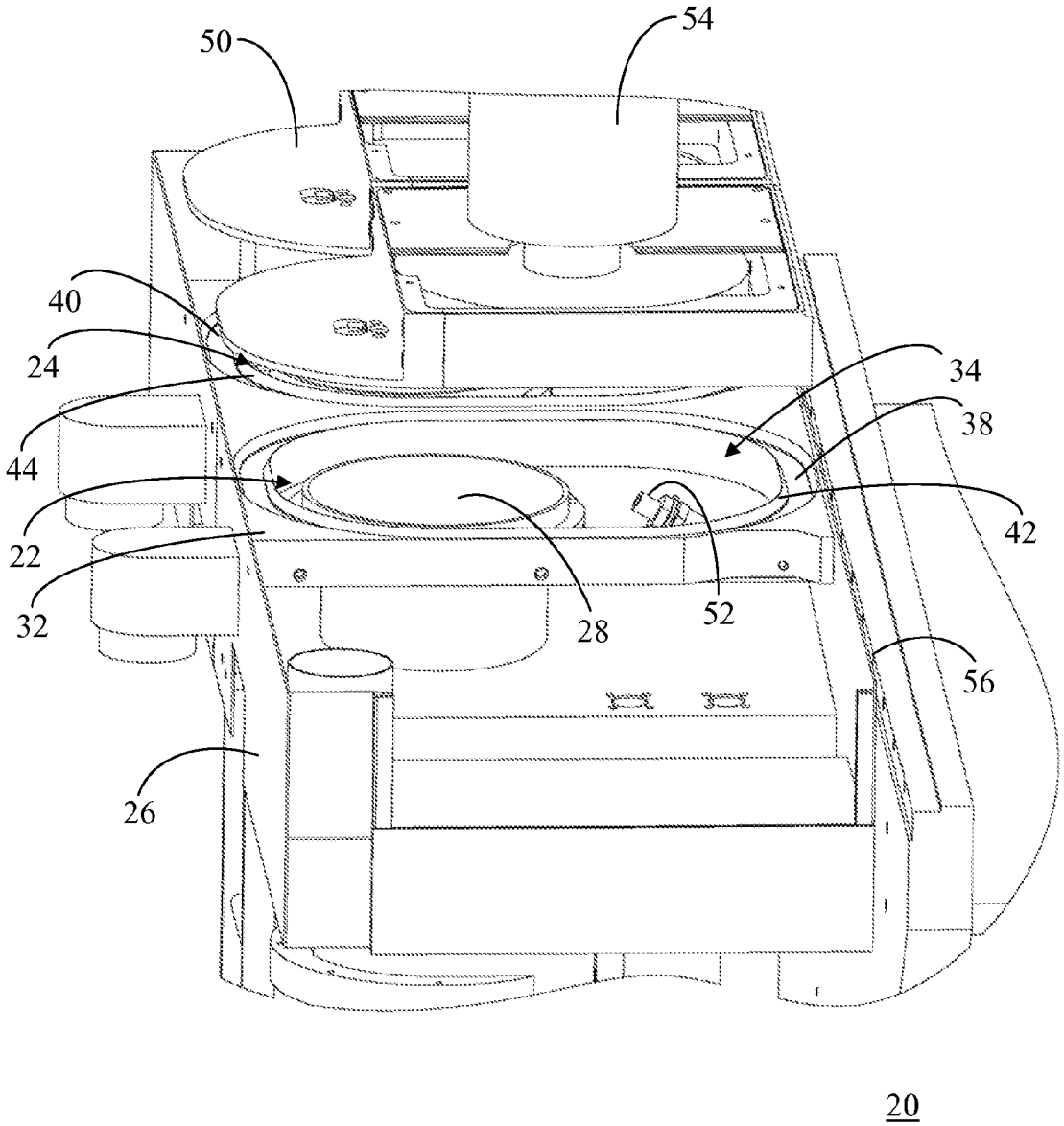
FIG. 1 shows a partial perspective view of a prior art surface grinding apparatus.
Figure 2:
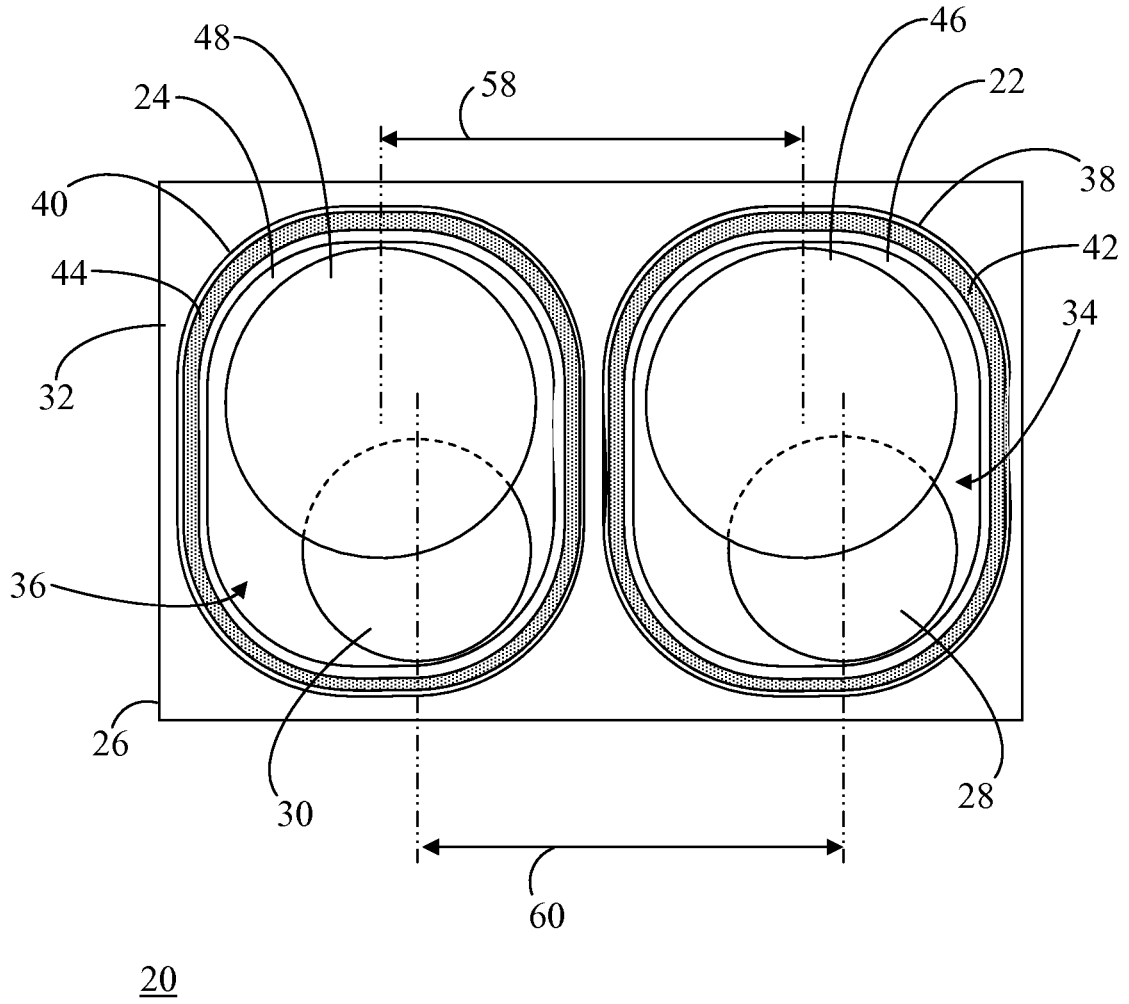
FIG. 2 shows an illustration of a partial top view of the prior art surface grinding apparatus.

System 102 includes a grind chamber 104, a mounting plate 106, a grind seal system 108, a sealing plate 110, a right (i.e., first) seal flap 112, a left (i.e., second) seal flap 114, actuators 116, and multiple proximity sensors 118, 120, 122, 124, and 126 mounted to a track 128. Grind chamber 104 replaces first and second grind chambers 22 and 24, respectively, of surface grinding apparatus 20 (FIG. 1). Grind chamber 104 is sized to accommodate both of right and left spindles 28 and 30. As such, the single grind chamber 104 is implemented in lieu of the two distinct grind chambers 22 and 24 of apparatus 20. Mounting plate 106 is coupled to a top of grind chamber 104. Mounting plate 106 includes a single opening 130 and a mounting section 132 encircling opening 130. Grind seal system 108 resides in mounting section 132, and will be further discussed in connection with FIGS. 10-12. It should be observed in FIG. 8 that sealing plate 110 has been translated leftward to reveal the region of grind chamber 104 in which right spindle 28 is located. However, in FIG. 8, left spindle 28 and right and left grinding wheels 46 and 48 are hidden from or covered by sealing plate 110. As such, both of right and left spindles 28 and 30, as well as both of right and left grinding wheels 46 and 48 are represented in FIG. 9.

Right and left grinding wheels 46 and 48 extend downwardly through sealing plate 110 and may be vertically adjusted to reside in grind chamber 104. Coolant nozzles 52 (of which only one is visible in FIG. 8) are suitably positioned in grind chamber 104 to direct water onto right and left grinding wheels 46 and 48 and workpieces 70 and 72 on right and left spindles 28 and 30 during grinding and edge trimming operations. Each of right and left grinding wheels 46 and 48, respectively, is attached to a separate grind spindle 54, of which only one is visible in FIG. 8, and grind spindles 54 are coupled to bridge element 56.

In general, rotational axes of right and left grinding wheels 46 and 48 are laterally displaced from one another by a fixed distance 131. Likewise, centers of right and left spindles 28 and 30 are laterally displaced from one another by a fixed distance 133. In accordance with system 102, distance 133 between right spindle 28 and left spindle 30 of apparatus 100 is greater than distance 60 between right and left spindles 28 and 30 of surface grinding apparatus 20. By way of example, right spindle 28 has been moved to the right approximately one inch in apparatus 100 relative to its location in apparatus 20. Likewise, distance 131 between right and left grinding wheels 46 and 48 is also increased by a similar amount to maintain surface grinding geometry requirements.

Bridge element 56 controls the linear position, or translation, of right grinding wheel 46, left grinding wheel 48, and sealing plate 110 relative to right and left spindles 28 and 30, respectively. Accordingly, right grinding wheel 46, left grinding wheel 48, and sealing plate 110 can be directed to move laterally relative to right and left spindles 28 and 30 to suitable positions (discussed below) for either of surface grinding and/or edge trimming operations. Sealing plate 110 is modified from sealing plate 20 (FIG. 1) of apparatus 20 (FIG. 1) in order to accommodate the larger spacing between right and left grinding wheels 46 and 48, respectively, and to provide suitable geometry and mounting means to mount right seal flap 112, left seal flap 114, and actuators 116. In particular, right and left seal flaps 112 and 114 are coupled to opposing edges of sealing plate 110, which correspond to the opposing edges of bridge element 56.

As will be discussed in significantly greater detail below, the larger spacing between right and left grinding wheels 46 and 48, as well as between right and left spindles 28 and 30, allows for positioning one of right and left grinding wheels 46 and 48 at a location between right and left spindles 28 and 30 suitable for performing edge trimming operations on one of first and second workpieces 70 and 72 seated on right and left spindles 28 and 30. For example, as represented in ghost form by dotted lines, right and left grinding wheels 46 and 48 can be translated so that one of grinding wheels 46 and 48 overlies the edge region of one of workpieces 70 and 72 in order to perform an edge trimming operation. The spacing between right and left spindles 28 and 30 is sufficient to allow one of grinding wheels 46 and 48 to grind either of workpieces 70 and 72 without allowing the grinding wheel to contact the other spindle and/or workpiece. It should be noted that during the edge trimming operation, the other of grinding wheels 46 and 48 will be raised up a safe height so that it will not come into contact with the edge region of the other one of workpieces 70 and 72.

In an embodiment, one each of actuators 116 is coupled to one each of right and left seal flaps 112 and 114. Each actuator 116 is an air cylinder which moves right and left seal flaps 112 and 114 between a down position 134 and an up position (not shown). Actuators 116 are controlled by a seal flap control element (discussed below) in order to selectively move right and left seal flaps 112 and 114 between down position 134 and the up position. In FIG. 8, each of right and left seal flaps 112 and 114 are illustrated in down position 134, in which a planar surface of each of seal flaps 112 and 114 is oriented substantially horizontal.

In down position 134, a lower surface of either of seal flaps 112 and 114 can rest on a portion of grind seal system 108 so as to form a cover or barrier to limit a spray of water and effluent out of grind chamber 104 during edge trimming operations. This will be discussed in greater detail below. The up position (not shown) is one in which the planar surface of each of seal flaps 112 and 114 is moved or pivoted upwardly so that it no longer rests on any portion of grind seal system 108. Right and left seal flaps 112 and 114 are selectively moved or pivoted to the up position in order to allow bridge element 56 to fully move left to right and vice versa. For example, right and left seal flaps 112 and 114 are moved to the up position to enable the normal translational movement and functions of apparatus 100.

Sealing plate 110 is further modified from sealing plate 20 (FIG. 1) of apparatus 20 (FIG. 1) to include a slot 136, and a probe slot cover 138 may be mounted inside of slot 136 formed in sealing plate 110. Slot 136 allows access for wafer thickness measurement probes 140 to be appropriately mounted so as to contact an area on each of right and left spindles 28 and 30, respectively, and first and second workpieces 70 and 72. For example, for surface grinding, probes 140 can be positioned so as to measure the thickness of corresponding first and second workpieces 70 and 72 during grinding. For edge trimming, probes 140 can be positioned on the portion of first or second workpieces 70 and 72 being trimmed. Probe slot cover 138 prevents grind effluent from splashing out of slot 136. Additionally, a front seal 142 and a back seal 144 may be added to further help contain water and effluent while grinding.

In an embodiment, apparatus 100 may include five sensors 118, 120, 122, 124, and 126. Track 128 may include a slot through its continuous length, and sensors 118, 120, 122, 124, and 126 can be mounted on brackets 146 which slide on track 128. Thus, sensors 118, 120, 122, 124, and 126 are adjustably mounted on track 128. Sensors 118, 120, 122, 124, and 126 may be proximity sensors for sensing certain positions of bridge element 56 travel in order to control the operation of first and second seal flaps 112 and 114 and to control the operation of grind seal system 108 for both surface grinding and edge trimming (discussed below).

Figure 10:
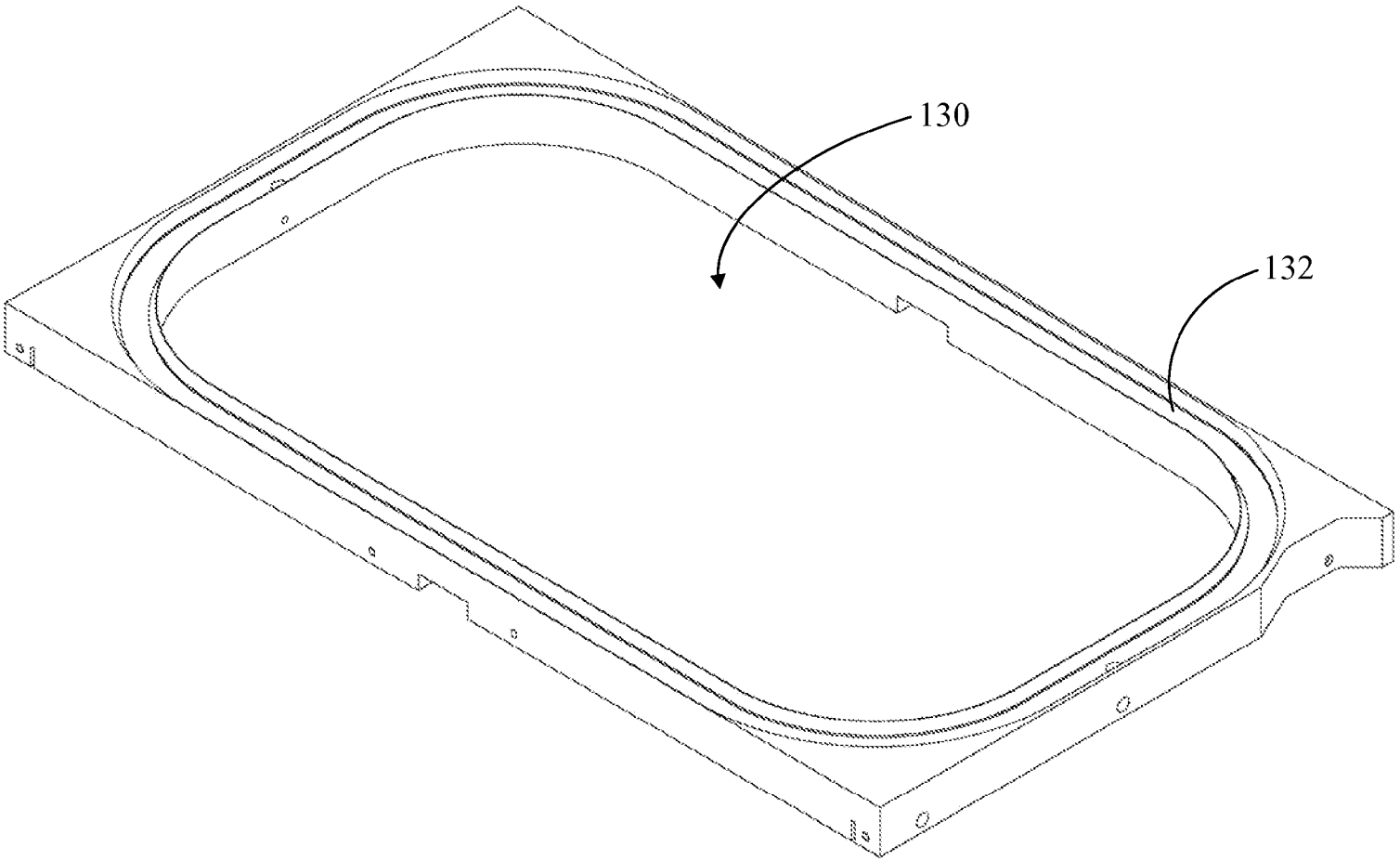
FIG. 10 shows a perspective view of a mounting plate of the apparatus of FIG. 8.
Figure 11:
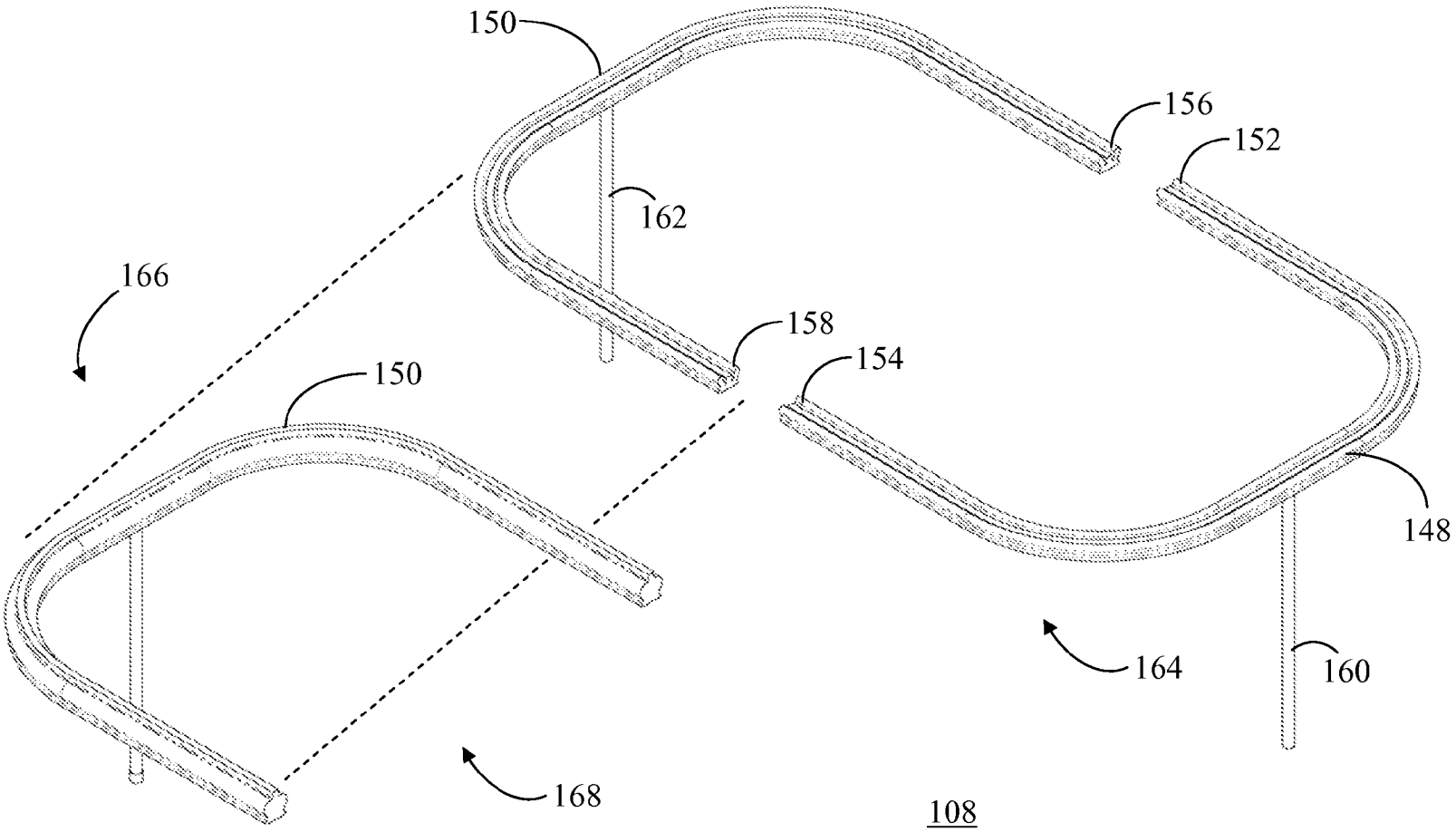
FIG. 11 shows a perspective view of a grind seal system for the apparatus of FIG. 8.
Figure 12:
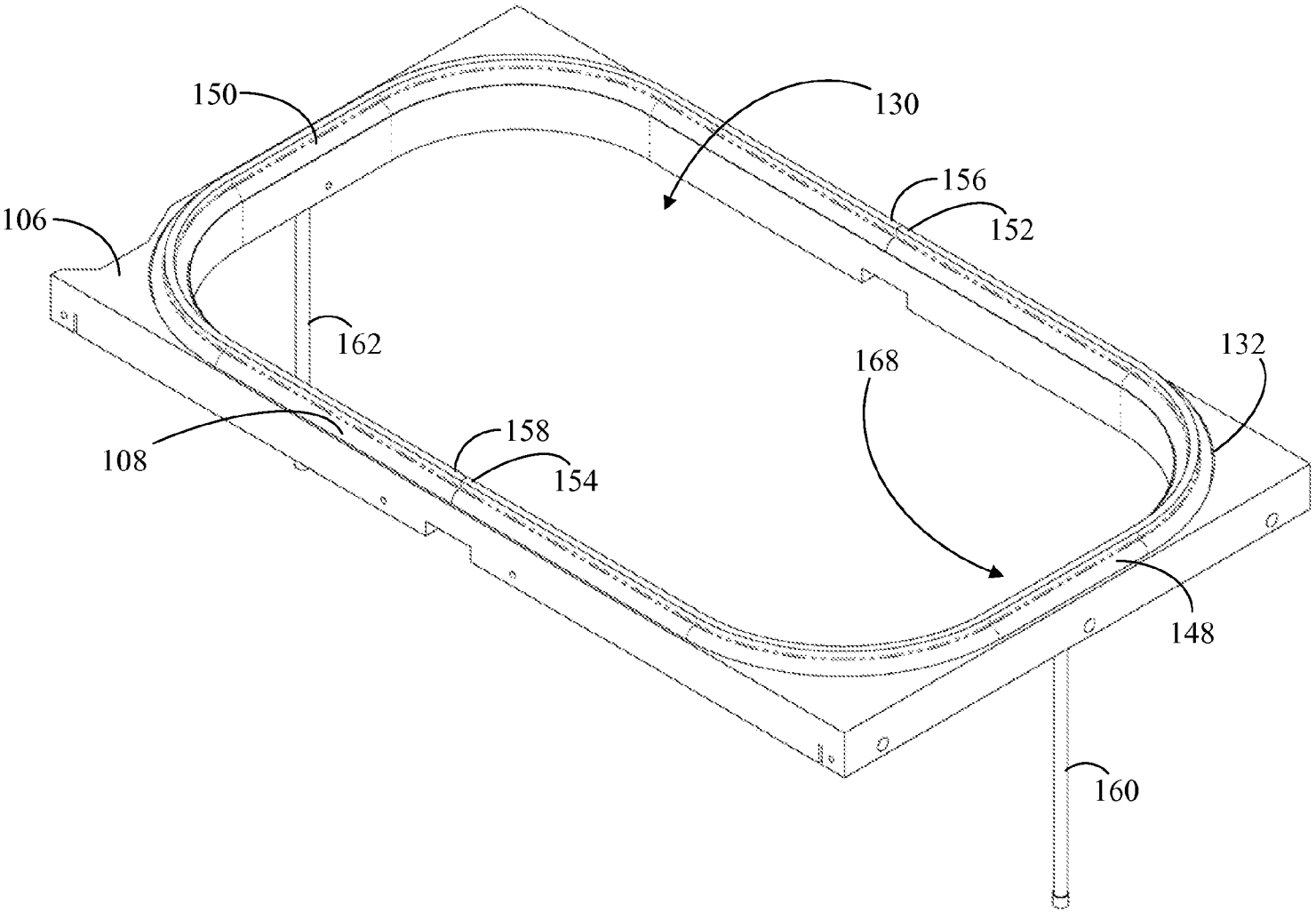
FIG. 12 shows a perspective view of the grind seal system installed in the mounting plate of FIG. 10.

Referring to FIGS. 10-12, FIG. 10 shows a perspective view of mounting plate 106 of the apparatus 100 (FIG. 8). FIG. 11 shows a perspective view of grind seal system 108 for apparatus 100, and FIG. 12 shows a perspective view of grind seal system 108 installed in mounting plate 106. As shown in FIG. 10, mounting plate 106 includes opening 130 with mounting section 132 encircling opening 130. Again, the single opening 130 of mounting plate 106 replaces first and second openings 34 and 36, respectively, (FIG. 1) in mounting plate 32 (FIG. 1) of apparatus 20 (FIG. 1).

As best illustrated in FIG. 11, grind seal system 108 includes a right (i.e., first) grind seal 148 and a left (i.e., second) grind seal 150. In an embodiment, each of right and left grind seals 148 and 150 is substantially linear. That is, right and left grind seals 148 and 150 are not formed in a continuous oval ring like first and second grind seals 42 and 44 (FIG. 1) of surface grinding apparatus 10. Instead, each of right and left grind seals 148 and 150 has a substantially linear configuration, with right grind seal 148 having a first end 152 and a second end 154 and left grind seal 150 having a third end 156 and a fourth end 158. Additionally, right and left grind seals 148 and 150 are flexible so as to fit into mounting section 132 of mounting plate 130 with first end 152 abutting third end 156 and second end 154 abutting fourth end 158. Accordingly, when right and left grind seals 148 and 150 are positioned in mounting section 132, they form a substantially curvilinear shape that encircles opening 130 of mounting plate 106 and, hence, the top opening of grind chamber 104 (FIG. 8).

Each of right and left grind seals 148 and 150 is inflatable. Accordingly, a first supply tube 160 is coupled to right grind seal 148 and a second supply tube 162 is coupled to left grind seal 150. Each of first and second supply tubes 160 and 162 are connected to an air source (not shown). In an embodiment, grind seals 148 and 150 are controlled by a grind seal control element (discussed below) in order to selectively inflate and deflate grind seals 148 and 150. FIG. 11 shows both of right and left grind seals 148 and 150 in a deflated state 164. Additionally, FIG. 11 presents a second view 166 of left grind seal 150 in an inflated state 168. FIG. 12 shows right and left grind seals 148 and 150 installed in mounting section 132 of mounting plate, with both of first and second grind seals 148 and 150 in inflated state 168. The geometry of right and left grind seals 148 and 150 eliminates any seals from residing within the area between right and left spindles 28 and 30 (FIG.

8), which could otherwise interfere with right and left grind wheels 46 and 48 (FIG. 9) during edge trimming operations.

Figure 13:
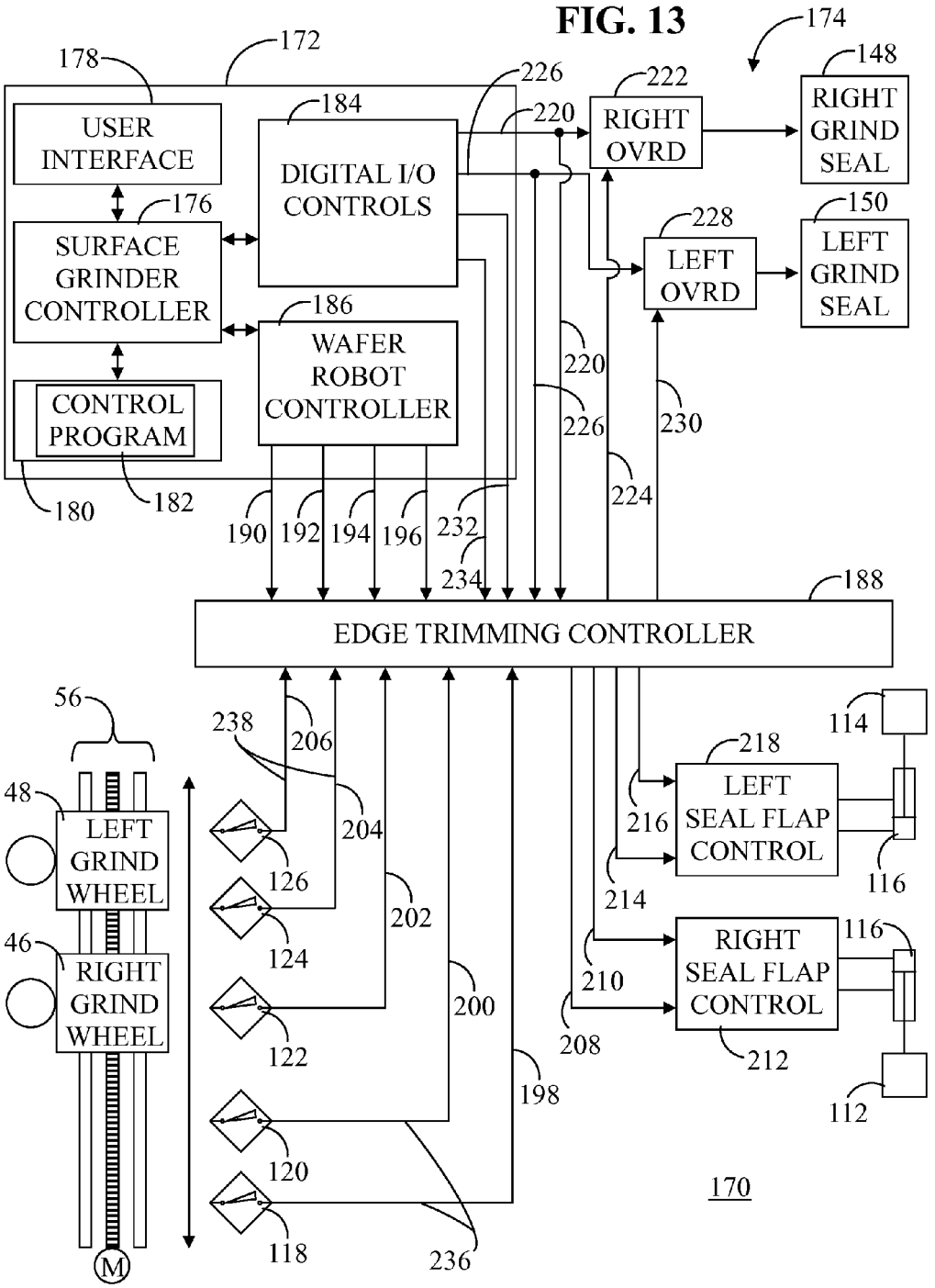
FIG. 13 shows a block diagram of the control system for the apparatus of FIG. 8.

FIG. 13 shows a block diagram of a control system 170 for apparatus 100 (FIG. 8). As mentioned previously, apparatus 100 is surface grinding apparatus 20 (FIG. 1) which has been adapted to additionally perform edge trimming. Thus, control system 170 for apparatus 100 includes a primary control system 172 and an edge trimming control system 174. Primary control system 172 may be legacy hardware and software that was originally provided with apparatus 100 prior to its modification. As such, primary control system 172 can include a surface grinder controller 176 in communication with a user interface 178 and a memory element 180. Memory element 180 can include executable code, referred to herein as a control program 182, that enables a user to enter position values via user interface 178 to control the position of bridge element 56. Surface grinder controller 176 may additionally be in communication with a digital input/output (I/O) controls 184 and a wafer robot controller 186. In accordance with an embodiment, surface grinder controller 176 controls digital I/O controls 184 and wafer robot controller 186 without alterations to control program 182. Those skilled in the art will recognize that primary control system 172 can include many more components and features than those which are discussed herein.

In an embodiment, edge trimming control system 174 includes an edge trimming controller 188 configured to receive signals from primary control system 172. For example, the software for wafer robot controller 186 may be modified to add handshaking signals between wafer robot controller 186 and edge trimming controller 188 to facilitate control of right and left seal flaps 112 and 114 during loading and unloading of first and second workpieces 70 and 72 (FIG. 9) onto right and left spindles 28 and 30 (FIG. 9). The handshaking signals include, for example, a right wafer get/put signal 190, a left wafer get/put signal 192, a done signal 194, and an error event signal 196, each of which will be discussed below.

Edge trimming controller 188 is further in communication with each of proximity sensors 118, 120, 122, 124, and 126 for receiving a corresponding position signal 198, 200, 202, 204, and 206 from each associated one of sensors 118, 120, 122, 124, and 126. Position signals 198, 200, 202, 204, and 206 are used to sense the position of bridge element 56 and resolve the control of first and second seal flaps 112 and 114 as well as to sense when apparatus 100 is being used for edge trimming operations.

Edge trimming controller 188 provides a first solenoid signal 208 and a second solenoid signal 210 to a right seal flap control valve 212 which controls actuator 116 associated with right seal flap 112. Likewise, edge trimming controller 188 provides a third solenoid signal 214 and a fourth solenoid signal 216 to a left seal flap control valve 218 which controls actuator 116 associated with left seal flap 114.

Edge trimming controller 188 is in communication with digital I/O controls 184 in order to monitor the inflation states of each of right and left grind seals 148 and 150. For example, digital I/O controls 184 provides a right grind seal state signal 220 to both of a right grind seal solenoid valve 222 and to edge trimming controller 188. Additionally, edge trimming controller 188 is capable of providing a right grind seal override signal 224 to right grind seal solenoid valve 222. Right solenoid valve 222 is in communication with right grind seal 148. Likewise, digital I/O controls 184 provides a left grind seal state signal 226 to both of a left grind seal solenoid valve 228 and to edge trimming controller 188. Additionally, edge trimming controller 188 is capable of providing a left grind seal override signal 230 to left grind seal solenoid valve 228, and left solenoid valve 228 is in communication with left grind seal 150.

Edge trimming controller 188 is further in communication with digital controls 184 in order to monitor the conditioning state for each of right and left grinding wheels 46 and 48, respectively (FIG. 9). For example, digital I/O controls 184 provides a right conditioning arm down signal 232 to edge trimming controller 188 to indicate a position of right conditioning arm (not shown) conventionally used to condition the surface of right spindle 28. Similarly, digital I/O controls 184 provides a left conditioning arm down signal 234 to edge trimming controller 188 to indicate a position of a left conditioning arm (not shown) conventionally used to condition the surface of left spindle 30. Although various signals (e.g., right wafer get/put signal 190, left wafer get/put signal 192, done signal 194, error event signal 196, right grind seal state signal 220, left grind seal state signal 226, right conditioning arm down signal 232, and left conditioning arm down signal 234) are illustrated as being output from primary control system 172 and input to edge trimming control system 174, it should be understood that these same signals may be concurrently routed to the elements of apparatus 100 (modified from surface grinding apparatus 20) for which they were originally intended.

Right wafer get/put signal 190, left wafer get/put signal 192, done signal 194, and error event signal 196 are provided to edge trimming controller 188 from wafer robot controller 186 and allow control of right and left seal flaps 112 and 114 any time that a conventional wafer handling robot (not shown) associated with apparatus 100 is placing or removing a workpiece, i.e., wafer, from either of right spindle 28 (FIG. 9) or left spindle 30 (FIG. 9).

In an illustrative example, when the robot is commanded to place or get a workpiece, such as first workpiece 70 (FIG. 9) on or from right spindle 28, wafer robot controller 186 sets right wafer get/put signal 190 and delays further action for a predetermined period of time. This time delay allows enough time for right seal flap 112 to move from down position 134 (FIG. 8) against grind seal system 108 (FIG. 8) to the up position away from grind seal system 108. Edge trimming controller 188 reacts to right wafer get/put signal 190 and raises right seal flap 112 to the up position by setting first solenoid signal 208 to "ON" and second solenoid signal 210 to "OFF" and communicating signals 208 and 210 to a right seal flap control valve 212 which in turn controls actuator 116 to raise right seal flap 112 to the up position. Right seal flap control valve 212 may be a latching valve to retain right seal flap 112 in position during power loss. Right seal flap 112 remains in the up position until the robot has completed the loading or unloading of the wafer, e.g., first workpiece 70 (FIG. 9), from right spindle 28. When the loading or unloading is completed, wafer robot controller 186 sets done signal 194. Edge trimming controller 188 reacts to done signal 194 by setting first solenoid signal 208 to "OFF" and second solenoid signal 210 to "ON" and communicating signals 208 and 210 to right seal flap control valve 212 which in turn controls actuator 116 to lower right seal flap 112 to down position 134. First solenoid signal 208 raises right seal flap 112 and second solenoid signal 210 lowers right seal flap 112, where the signals 208 and 210 are mutually exclusive.

In another illustrative example pertinent to left spindle 30, when the robot is commanded to place or get a workpiece, such as second workpiece 72 (FIG. 9) on or from left spindle 30, the robot sets left wafer get/put signal 192 and delays further action for a predetermined period of time. This time delay allows enough time for left seal flap 114 to move from down position 134 (FIG. 8) against grind seal system 108 (FIG. 8) to the up position away from grind seal system 108. Edge trimming controller 188 reacts to left wafer get/put signal 192 and raises left seal flap 114 to the up position by setting third solenoid signal 214 to "ON" and fourth solenoid signal 216 to "OFF" and communicating signals 214 and 216 to left seal flap control valve 218 which in turn controls actuator 116 to raise left seal flap 114 to the up position. Left seal flap control valve 218 may be a latching valve to retain left seal flap 114 in position during power loss. Left seal flap 114 remains in the up position until the robot has completed the loading or unloading of the wafer, e.g., second workpiece 72, from left spindle 30. When the loading or unloading is completed, wafer robot controller 186 sets done signal 194. Edge trimming controller 188 reacts to done signal 194 by setting third solenoid signal 214 to "OFF" and fourth solenoid signal 216 to "ON" and communicating signals 214 and 216 to left seal flap control valve 218 which in turn controls actuator 116 to lower left seal flap 114 to down position 134. Third solenoid signal 214 raises left seal flap 114 and fourth solenoid signal 216 lowers left seal flap 114, where the signals 214 and 216 are mutually exclusive. Thus, edge trimming controller 188 functions as a seal flap control element in communication with right and left seal flaps 112 and 114 for controlling the position of right and left seal flaps 112 and 114 in response to signaling from wafer robot controller 186.

As mentioned previously, signals 198, 200, 202, 204, and 206 from sensors 118, 120, 122, 124, and 126 are used to sense the position of bridge element 56, to resolve the control of right and left seal flaps 112 and 114, and to sense when apparatus is used for edge trimming. A pair of sensors is used for each of right and left seal flaps 112 and 114 to account for a discontinuity of bridge element 56 over its entire span of travel and for edge trimming position resolution. Each sensor pair is treated as one by edge trimming controller 188 for control of right and left seal flaps 112 and 114. Sensors 118 and 120 are a right (i.e., first) sensor pair 236 that is suitably positioned to provide signals 198 and 200 to cause right seal flap 112 to raise from down position 134 (FIG. 8) to the up position to allow bridge element 56 to travel to the "full right" position without interference between right seal flap 112 and the machine frame when bridge element 56 is moving rightward. These same signals 198 and 200 are used to lower right seal flap 112 to down position 134 when bridge element 56 is moving left.

Sensors 124 and 126 are a left (i.e., second) sensor pair 238 that is suitably positioned to provide signals 204 and 206 to cause left seal flap 112 to raise from down position 134 to the up position to allow bridge element 56 to travel to the "full left" position without interference between left seal flap 114 and the machine frame when bridge element 56 is moving leftward. These same signals 204 and 206 are used to lower left seal flap 114 to down position 134 when bridge element 56 is moving right. The fifth proximity sensor, i.e., sensor 122, combined with sensor 120 or sensor 124 are used for determining when apparatus 100 is edge trimming.

Figure 3:
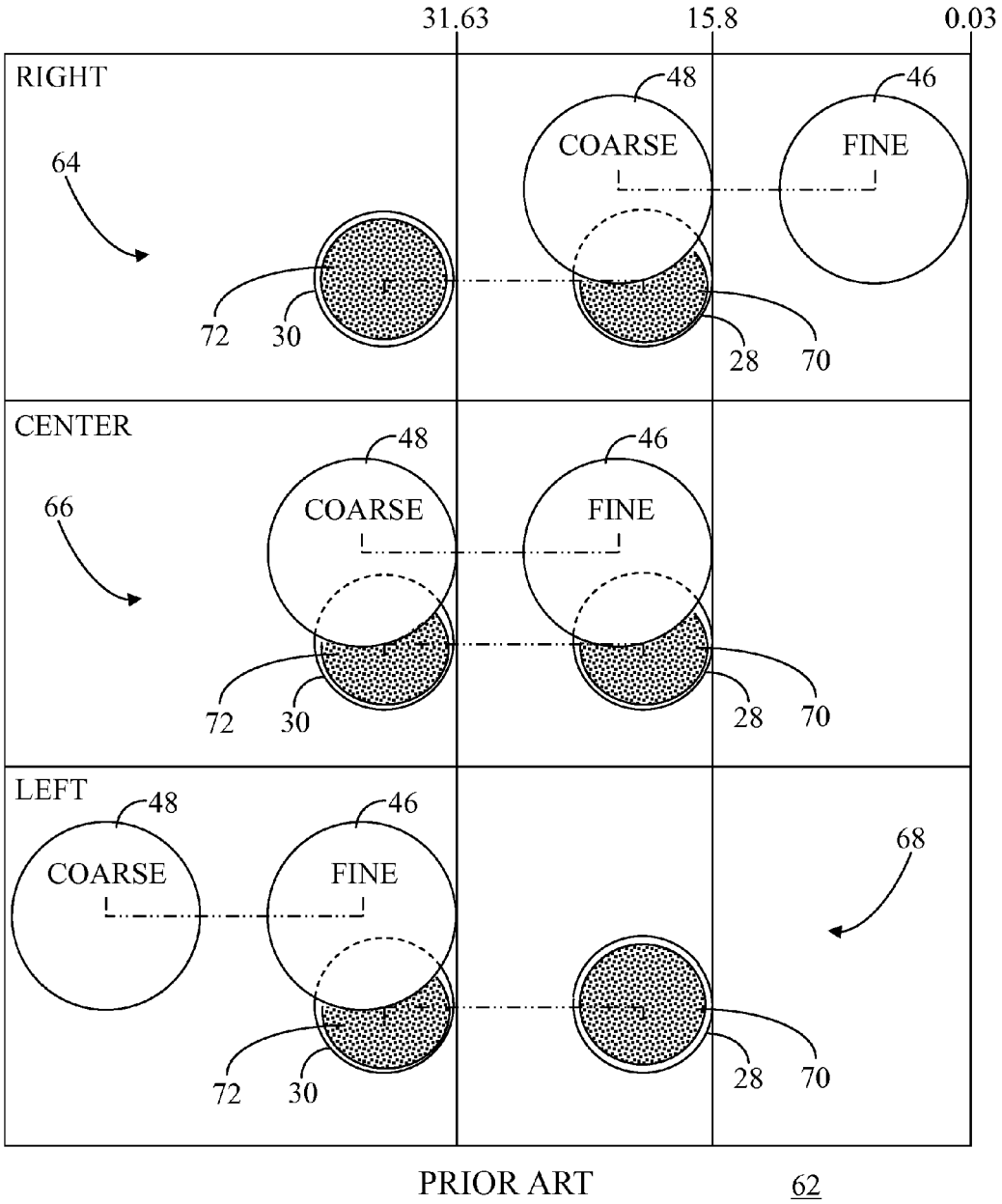
FIG. 3 shows a chart representing surface grinding positions in which the prior art surface grinding apparatus can be placed.
Figure 14:
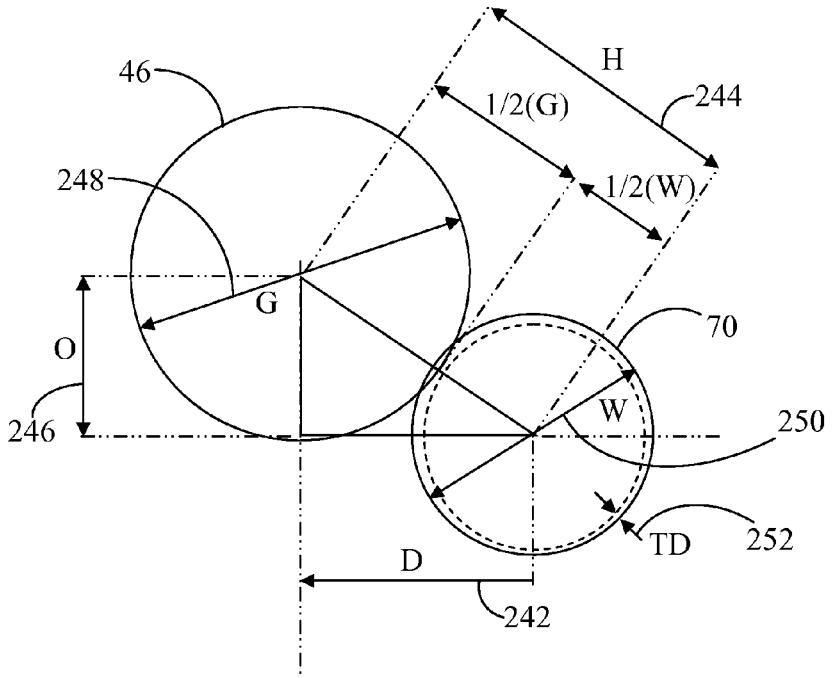
FIG. 14 shows a chart representing a computation for positioning right and left grind wheels in order to perform edge trimming using apparatus.

FIG. 14 shows a chart 240 representing a computation for positioning either of right and left grind wheels 46 and 48 in order to perform edge trimming using apparatus 100 (FIG. 8). As mentioned previously, a user can enter values for various grinding positions as prompted by control program 182 via user interface 178 (FIG. 13) of primary control system 172 (FIG. 13). By away of example, each of apparatus 20 (FIG. 1) and apparatus 100 may be programmed with particular values for right surface grinding position 64 (FIG. 3), center surface grinding position 66 (FIG. 3), and left surface grinding position 68 (FIG. 3) to enable surface grinding of workpieces.

In an embodiment, values can be entered as prompted by control program 182 by a user that suitably positions first and second grinding wheels 46 and 48 (FIG. 9) to enable edge trimming. Chart 240 summarizes the relationship of a grind wheel, e.g., right grind wheel 46, to a workpiece, first workpiece 70, for determining a position of bridge element 56 (FIG. 8) in order to perform edge trimming. Since the distance between the rotational axis of grind wheel 46 and the center of workpiece 70 is constant, by virtue of a constant distance between the rotational axis of grind wheel 46 and the center of one of spindles 28 and 30 (FIG. 9), the offset of bridge element 56 from the center of first workpiece 72 can be readily determined using Pythagoras' theorem, as represented in chart 240.

An offset value from wafer center suitable for performing edge trimming, i.e., a distance (D) 242, is the square root of the hypotenuse (H) 244 minus the side opposite (O) 246. Hypotenuse 244 is readily computed as the sum of half of a diameter, G, 248 of grinding wheel 46 (i.e. the grinding wheel radius) and half of a diameter, W, 250 of workpiece 70 (i.e. the workpiece radius) minus the amount of overlap between grinding wheel 46 and workpiece 70. This overlap is an edge trimming distance 252.

In an example, grinding wheel diameter 248 may be 11.094 inches (28.2 cm), workpiece diameter 250 may be 7.874 inches (20 cm), and edge trimming distance 252 may be 0.276 inches (0.7 cm). Accordingly, the value of hypotenuse (H) 244 is 9.208 inches (23.4 cm). Side opposite (O) 246 is a constant value 5.25 inches (13.3 cm). Therefore, distance (D) 242, the offset between the center of grinding wheel 46 and workpiece 70 suitable for performing edge trimming, is 7.565 inches (19.2 cm).

Figure 15:
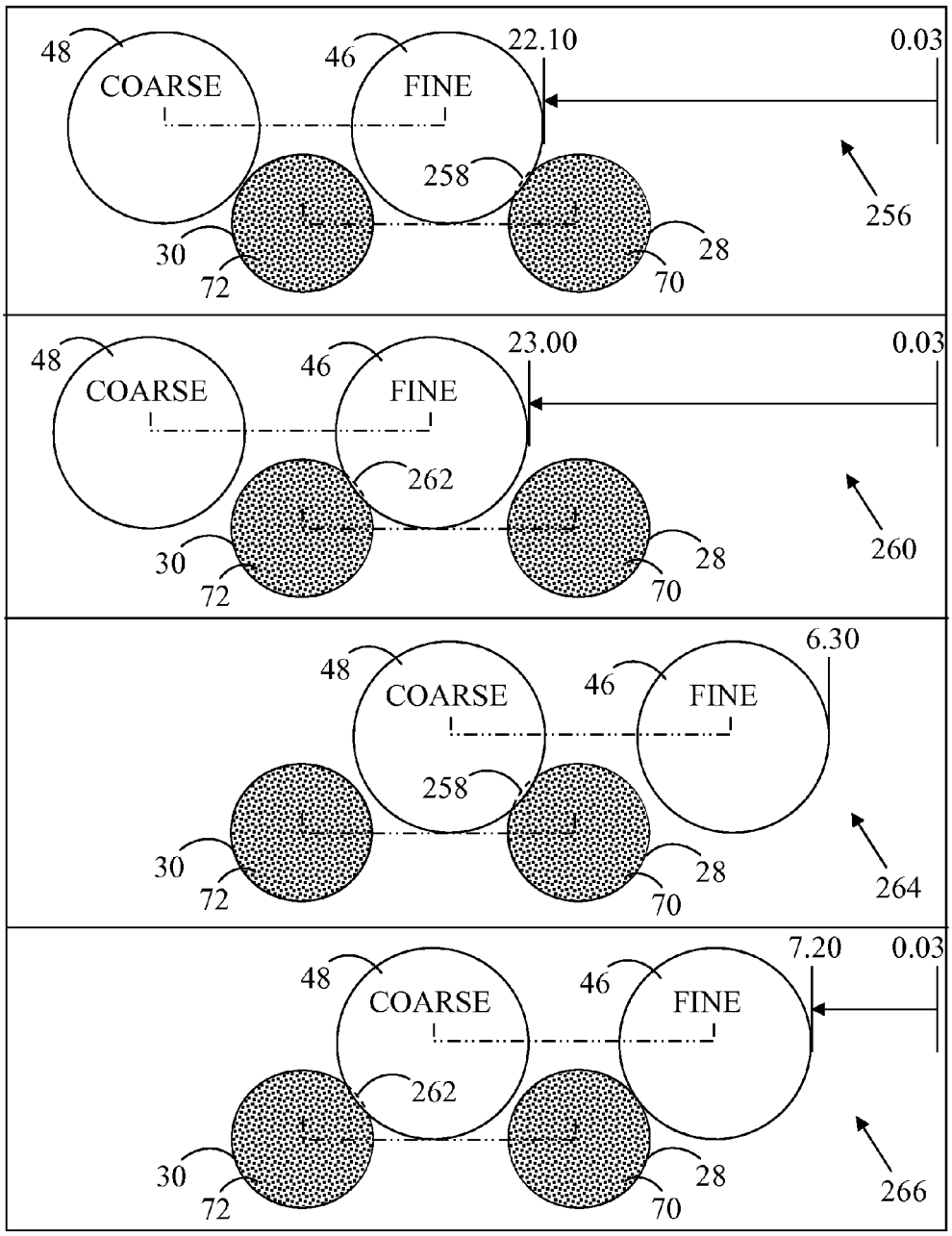
FIG. 15 shows a chart representing multiple edge trimming positions in which the apparatus of FIG. 8 can be placed in accordance with an embodiment.

FIG. 15 shows a chart 254 representing multiple edge trimming positions in which apparatus 100 (FIG. 8) can be placed in accordance with an embodiment. In particular, chart 254 summarizes four possible edge trimming positions. The edge trimming positions of chart 254 can be ascertained by a priori knowledge of distance (D) 242 (FIG. 14), the offset distance needed between the center of the grinding wheel and the center of the workpiece suitable for performing edge trimming.

Bridge element 56 (FIG. 8) may be translated to a first edge trimming position 256 in which right grinding wheel 46 is positioned between right and left spindles 28 and 30, respectively, and overlies a first outer edge 258 of first workpiece 70 residing on right spindle 28. Bridge element 56 may alternatively be translated to a second edge trimming position 260 in which right grinding wheel 46 is positioned between right and left spindles 28 and 30 and overlies a second outer edge 262 of second workpiece 72 residing on left spindle 30. Bridge element 56 may also be translated to a third edge trimming position 264 in which left grinding wheel 48 is positioned between right and left spindles 28 and 30 and overlies first outer edge 258 of first workpiece 70 residing on right spindle 28. And bridge element 56 may be translated to a fourth edge trimming position 266 in which left grinding wheel 48 is positioned between right and left spindles 28 and 30 and overlies second outer edge 262 of second workpiece 72 residing on left spindle 30.

The particular choice of first and second edge trimming positions 256 and 260 using the fine grinding wheel 46, or third and fourth edge trimming positions 264 and 266 using the coarse grinding wheel 48 can be determined by the user, the material composition of first and second workpieces 70 and 72, and so forth.

FIG. 16 shows a table 268 summarizing values that may be entered via user interface 178 (FIG. 13) of apparatus 100 to achieve multiple surface grinding positions (FIG. 3) and edge trimming positions (FIG. 14). Table 268 includes a surface grinding section 270 summarizing the three conventional surface grinding positions, e.g., right surface grinding position 64, center surface grinding position 66, and left surface grinding position 68 illustrated in FIG. 3. In addition, table 268 includes an edge trimming section 272 summarizing the four edge trimming positions, e.g., first edge trimming position 256, second edge trimming position 260, third edge trimming position 264, and fourth edge trimming position 266 illustrated in FIG. 15.

All positions are referenced from a home/right position 274. That is, bridge element 56 (FIG. 8) is "homed" by moving it all the way to the right limit switch, which is home. Bridge element 56 then translated off the switch to the left specified by right position 274. A center position 276 and a left position 278 are then defined as a distance from right position 274, as shown in table 268.

As revealed in edge trimming section 272 of table 268, the underlined value for each of edge trimming positions 256, 258, 264, and 266 is the "working" variable for the edge trimming process. That is, the underlined value indicates where bridge element 56 should be translated in order to perform edge trimming. For example, in first edge trimming position 256, bridge element 56 should be translated to center position 276, having been assigned a value of 22.10 inches (56.1 cm), when first edge trimming position 256 is desired. Similarly, in second edge trimming position 258, bridge element 56 should be translated to left position 278, having been assigned a value of 23 inches (58.4 cm). In third edge trimming position 264, bridge element 56 should remain in home position 274, having been assigned a value of 6.30 inches (16 cm). And in fourth edge trimming position 266, bridge element 56 should be translated to center position 276, having been assigned a value of 7.20 inches (18.3 cm).

All other associated values for each of edge trimming positions 256, 258, 264, and 266 are set as shown so that, based on the scheme explained above, bridge element 56 will go to the correct location for other movements/operations, such as workpiece loading and unloading. For example, if right position 274 is greater than essentially zero, and bridge element 56 needs to move to left position 278 so that the robot (not shown) can move workpieces on and of right spindle 28 (FIG. 9), then bridge element 56 could slam into the left end of its travel. This could happen when right position 274 is changed by a large amount because left position 278 is referenced by right position 274. Thus, left position 278 is reduced so that bridge element 56 cannot travel too far to the left.

Exemplary surface grinding positions 64, 66, 68 and edge trimming positions 256, 258, 264, 266 are shown herein having been assigned specific values to accommodate the modifications from surface grinding apparatus 20 (FIG. 1) to apparatus 100 (FIG. 8). These values correspond with the dimensions of apparatus 100 discussed in connection with FIG. 9, and with the legacy hardware and software of primary control system 172 (FIG. 13). Those skilled in the art should recognize that these values could be different then that which is shown to accommodate a different apparatus and/or different legacy and hardware and software.

FIG. 17 shows a table 280 summarizing proximity sensor states used to sense when apparatus 100 (FIG. 8) is being used for edge trimming operations. A first sensor state 282 is characterized by position signal 202 for proximity sensor 122 being in an "OFF" condition. That is, an "OFF" position signal 202 from proximity sensor 122 indicates that bridge element 56 is not positioned for edge trimming. The condition of the remaining position signals 198, 200, 204, and 206 for sensors 118, 120, 124, and 126 is not relevant because edge trimming controller 188 recognizes that an "OFF" position signal 202 from proximity sensor 122 indicates that bridge element 56 is not in an edge trimming position.

A second sensor state 284 is characterized by position signal 202 for proximity sensor 122 being in an "ON" condition. Additionally, both of position signals 198 and 200 for right sensor pair 236 of sensors 118 and 120 are in an "ON" condition, and position signal 204 for sensor 124 is in an "OFF" condition. The condition of position signal 206 for sensor 126 is not relevant because edge trimming controller 188 recognizes that this combination of positions signals 198, 200, 202, and 204 indicates that bridge element 56 is not in an edge trimming position.

A third sensor state 286 is characterized by position signal 202 for proximity sensor 122 being in an "ON" condition. Additionally, both of position signals 204 and 206 for right sensor pair 238 of sensors 124 and 126 are in an "ON" condition, and position signal 200 for sensor 120 is in an "OFF" condition. The condition of position signal 198 for sensor 1118 is not relevant because edge trimming controller 188 recognizes that this combination of positions signals 200, 202, 204, and 206 indicates that bridge element 56 is not in an edge trimming position.

A fourth sensor state 288 is characterized by position signal 202 for proximity sensor 122 being in an "ON" condition. Additionally, position signal 204 for sensor 124 is an "ON" condition, but the remaining position signals 198, 200, and 206 for sensors 118, 120, and 126 are all in an "OFF" condition. Edge trimming controller 188 recognizes that this combination of position signals 198, 200, 202, 204, and 206 indicates that bridge element 56 is in an edge trimming position such that left grind wheel 48 (FIG. 15) can perform edge trimming.

Similarly, a fifth sensor state 290 is characterized by position signal 202 for proximity sensor 122 being in an "ON" condition. Additionally, position signal 200 for sensor 120 is an "ON" condition, but the remaining position signals 198, 204, and 206 for sensors 118, 124, and 126 are all in an "OFF" condition. Edge trimming controller 188 recognizes that this combination of position signals 198, 200, 202, 204, and 206 indicates that bridge element 56 is in an edge trimming position such that right grind wheel 46 (FIG. 15) can perform edge trimming.

FIG. 18 shows a table 292 relating proximity sensor states with seal flap position and control. In particular, signals 198, 200, 204 and 206 from proximity sensors 118, 120, 124, and 126 are used by edge trimming controller 188 (FIG. 8) for resolving the control of right and left seal flaps 112 and 114, respectively (FIG. 8). Accordingly, edge trimming controller 188 functions as a seal flap control element in communication with right and left seal flaps 112 and 114 for controlling the position of right and left seal flaps 112 and 114 in response to the position of bridge element 56 as ascertained by position signals 198, 200, 204 and 206 from proximity sensors 118, 120, 124, and 126.

A first flap control sensor state 294 is characterized by position signals 198 and 200 for right sensor pair 236 of sensors 118 and 120 being in an "OFF" condition. This "OFF" condition indicates to edge trim controller 188 (FIG. 13) that bridge element 56 is moving to the left. Accordingly, edge trim controller 188 sets first solenoid signal 208 to "OFF" and second solenoid signal 210 to "ON" and communicates signals 208 and 210 to right seal flap control valve 212 (FIG. 13) which in turn controls actuator 116 (FIG. 13) associated with right seal flap 112 (FIG. 13) to cause right seal flap 112 to lower into down position 134 (FIG. 8).

A second flap control sensor state 296 is characterized by position signal 198 for sensor 118 being in an "ON" condition. In response, edge trim controller 188 sets first solenoid signal 208 to "ON" and second solenoid signal 210 to "OH" and communicates signals 208 and 210 to right seal flap control valve 212 which in turn controls actuator 116 associated with right seal flap 112 to cause right seal flap 112 to raise into the up position to allow bridge element 56 to travel to the full right position without interference between right seal flap 112 and the machine frame when bridge element 56 is moving right. Similarly, a third flap control sensor state 298 is characterized by position signal 200 for sensor 120 being in an "ON" condition. Again, edge trim controller 188 sets first solenoid signal 208 to "ON" and second solenoid signal 210 to "OFF" and communicates signals 208 and 210 to right seal flap control valve 212 to cause right seal flap 112 to raise into the up position to allow bridge element 56 to travel to the full right position.

A fourth flap control sensor state 300 is characterized by position signals 204 and 206 for left sensor pair 238 of sensors 124 and 126 being in an "OFF" condition. This "OFF" condition indicates to edge trim controller 188 (FIG. 13) that bridge element 56 is moving to the right. Accordingly, edge trim controller 188 sets third solenoid signal 214 to "OFF" and fourth solenoid signal 216 to "ON" and communicates signals 214 and 216 to left seal flap control valve 218 (FIG. 13) which in turn controls actuator 116 (FIG. 13) associated with left seal flap 114 (FIG. 13) to cause left seal flap 114 to lower into down position 134 (FIG. 8).

A fifth flap control sensor state 302 is characterized by position signal 204 for sensor 124 being in an "ON" condition. In response, edge trim controller 188 sets third solenoid signal 214 to "ON" and fourth solenoid signal 216 to "OH" and communicates signals 214 and 216 to left seal flap control valve 218 which in turn controls actuator 116 associated with left seal flap 114 to cause left seal flap 114 to raise into the up position to allow bridge element 56 to travel to the full left position without interference between left seal flap 114 and the machine frame when bridge element 56 is moving left. Similarly, a sixth flap control sensor state 304 is characterized by position signal 206 for sensor 126 being in an "ON" condition. Again, edge trim controller 188 sets third solenoid signal 214 to "ON" and fourth solenoid signal 216 to "OFF" and communicates signals 214 and 216 to left seal flap control valve 218 to cause left seal flap 114 to raise into the up position to allow bridge element 56 to travel to the full left position.

FIG. 19 shows a table 306 of grind seal conditions relative to edge trimming states. Typically, a surface grinding apparatus, such as apparatus 20 has two independent grind seals, e.g. first and second grind seals 42 and 44 (FIG. 1). In normal surface grinding operation, digital I/O controls 184 will send the appropriate right grind seal state signal 220 and a left grind seal state signal 226 so that either of grind seals 42 and 44 will inflate when that side of apparatus 20 is being used for surface grinding. The side of apparatus 20 not being used for surface grinding is left deflated. In accordance with an embodiment, edge trimming controller 188 uses signals 220 and 226 to insure that both of right and left grind seals 148 and 150 (FIG. 11) are inflated whenever either one of right and left grind seals 148 and 150 are commanded to be inflated by surface grinder controller 176. Since edge trimming controller 188 recognizes when apparatus is in an edge trimming state through position signals 198, 200, 202, 204, and 206 from respective proximity sensors 118, 120, 122, 124, and 126, edge trimming controller 188 thus functions as a grind seal control element for selectively directing right and left grind seals 148 and 150 to inflate and deflate in response to the position of bridge element 56 (FIG. 8).

For illustrative purposes, table 306 includes a surface grinding state 308 ascertained through position signals 198, 200, 202, 204, and 206 from respective proximity sensors 118, 120, 122, 124, and 126. This was as explained in connection with table 280 of FIG. 17. Edge trimming controller 188 only controls right and left grind seals 148 and 150 when apparatus 100 performs edge trimming. Accordingly, when apparatus is in surface grinding state 308, right and left grind seal state signals 220 and 226 are simply ignored by edge trimming controller 188. Furthermore, right grind seal override signal 224 and left grind seal override signal 230 are set to an "OFF" condition. As such, a grind seal condition 310 when surface grinding is not relevant to edge trimming controller 188.

Table 306 further illustrates a first edge trimming state 312 in which right and left grind seal state signals 220 and 226 are currently set to an "OFF" condition. In this instance, both right and left grind seals 148 and 150 are being commanded by digital I/O controls 184 (FIG. 13) to be deflated. Thus, right grind seal override signal 224 and left grind seal override signal 230 are also set to an "OFF" condition, and a grind seal condition 314 under this circumstance is one in which both right and left grind seals 148 and 150 are deflated.

In a second edge trimming state 316, right grind seal state signal 220 is currently set to an "ON" condition and left grind seal state signal 226 is currently set to an "OFF" condition. As mentioned, edge trimming controller 188 uses signals 220 and 226 to insure that both of right and left grind seals 148 and 150 (FIG. 11) are inflated whenever either one of right and left grind seals 148 and 150 are commanded to be inflated by surface grinder controller 176. Thus, right grind seal override signal 224 is set to an "OFF" condition. However, left grind seal override signal 230 is set to an "ON" condition in order to override left grind seal state signal 226. Thus, a grind seal condition 318 under this circumstance is one in which both right and left grind seals 148 and 150 are inflated.

Likewise, in a third edge trimming state 320, right grind seal state signal 220 is currently set to an "OFF" condition and left grind seal state signal 226 is currently set to an "ON" condition. Thus, right grind seal override signal 224 is set to an "ON" condition, and left grind seal override signal 230 is set to an "OFF" condition in order to override right grind seal state signal 220. As such, a grind seal condition 322 under this circumstance is one in which both right and left grind seals 148 and 150 are inflated.

In a fourth edge trimming state 324, both right and left grind seal state signals 220 and 226 are currently set to an "ON" condition. Thus, right grind seal override signal 224 and left grind seal override signal 230 are set to an "OFF" condition, and a grind seal condition 326 under this circumstance is one in which both right and left grind seals 148 and 150 are inflated. The command structure specified above enables both right and left grind seals 148 and 150 to be inflated any time either one of grind wheels 46 and 48 (FIG. 9) is performing edge trimming in order to seal grind chamber 104 (FIG. 8) and largely contain water and effluent when edge trimming.

Figure 20:
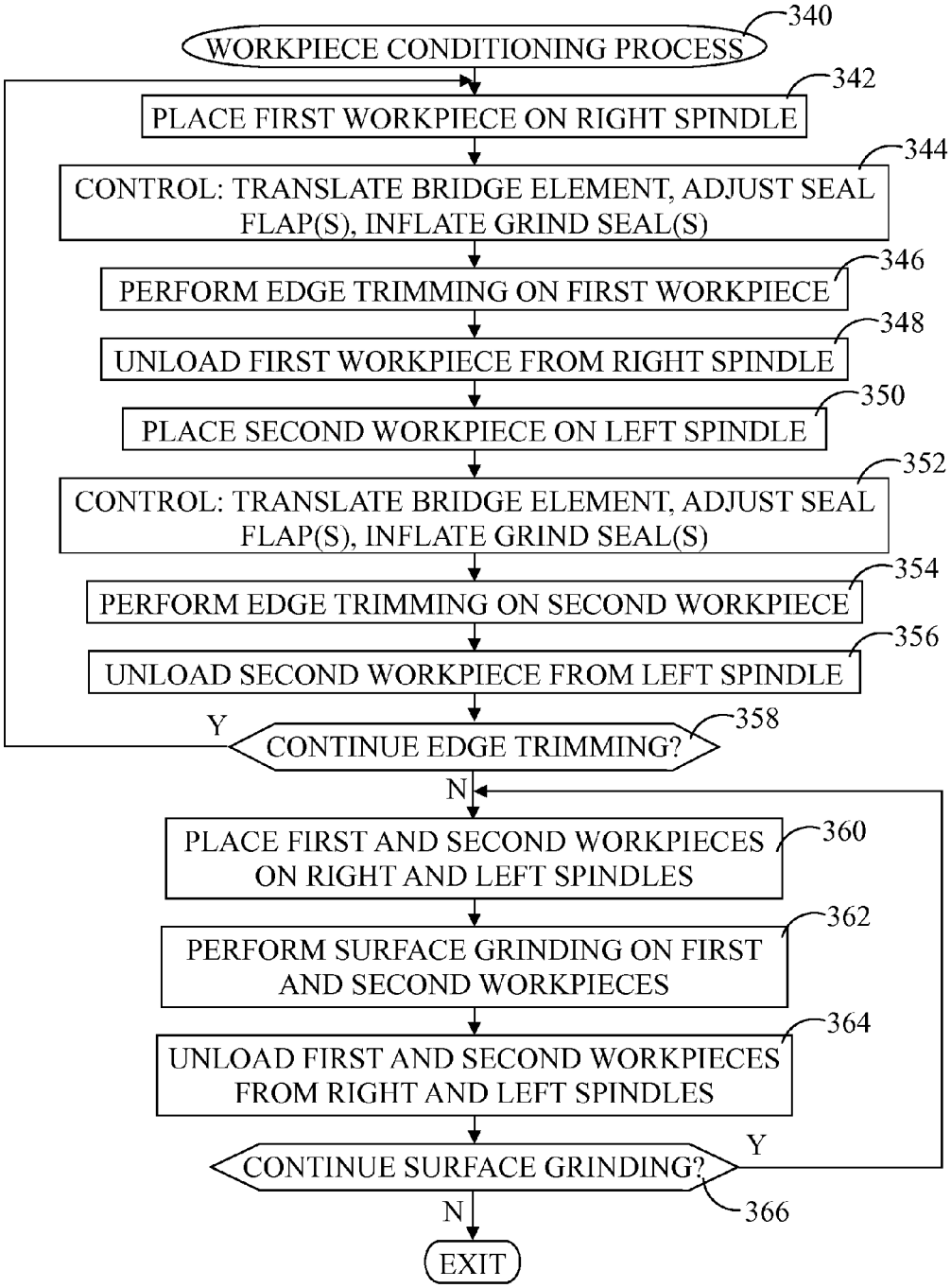
FIG. 20 shows a flowchart of a workpiece conditioning process.

FIG. 20 shows a flowchart of a workpiece conditioning process 340. Workpiece conditioning process 340 is executed in order to process two workpieces using apparatus 100 (FIG. 8) that is adapted to perform both surface grinding and edge trimming. In the illustrated embodiment, the two workpieces initially undergo edge trimming in a serial process in which only one of the workpieces is seated on its spindle for edge trimming at a given instant. The two workpieces then undergo surface grinding while both are seated on their respective spindles. However, in alternative embodiments, each of the two workpieces may remain on a particular spindle upon which it is initially placed during both edge trimming and surface grinding to reduce workpiece handling and optimize throughput. In still other embodiments, only a portion of workpiece conditioning process 340 will be executed in order to perform only edge trimming on multiple workpieces or only surface grinding on multiple workpieces.

The following process will be described in connection with conditioning first and second workpieces 70 and 72 (FIG. 9) for simplicity of illustration. It will be recognized, however, that the present embodiment is applicable to a variety of different types and configurations of workpieces. Process 340 provides an illustrative description of how apparatus 100 may be operated in order to perform both surface grinding and edge trimming on multiple workpieces. Those skilled in the art will recognize that the particular process steps may be varied substantially from the order described in accordance with particular manufacturers' processes.

Process 340 begins with a task 342. At task 342, first workpiece 70 is placed on right spindle 28 (FIG. 9). In some embodiments, first workpiece 70 may be a single wafer 74 such as that shown in FIG. 4, and in other embodiments the workpiece may be a bonded wafer pair 76, such as that shown in FIG. 5. First workpiece 70 may be placed on right spindle 28 using, for example, a conventional automated robot, and control system 170 communicates the appropriate control signals to translate bridge element 56 (FIG. 8) and control right and left seal flaps 112 and 114 (FIG. 8), as discussed above.

Next a task 344 is performed. Task 344 is a control task in which bridge element 56 is translated to one of first and third edge trimming positions 256 and 264 (FIGS. 15 and 16), the appropriate right and left seal flaps 112 and 114 are adjusted to allow translation of bridge element 56, both of right and left grind seals 148 and 150 (FIG. 11) are inflated in accordance with table 306 (FIG. 19), and so forth.

Following task 344, a task 346 is performed. At task 346, edge trimming is performed on first workpiece 70 using either of right and left grinding wheels 46 and 48 (FIG. 9), in accordance with the selected one of first and third edge trimming positions 256 and 264. During edge trimming, both right and left grind seals 148 and 150 are inflated and one or both of right and left seal flaps 112 and 114 is in down position 134 (FIG. 8) to contain water and grinding effluent.

Following edge trimming at task 346, a task 348 is performed. At task 348, first workpiece 70 is unloaded from right spindle 28. In order to unload first workpiece 70 at task 348, signaling will be initiated at control system 170 (FIG. 13) in order to translate bridge element 56 for workpiece unloading, to adjust first and second seal flaps 112 and 114 so that bridge element 56 can move rightward or leftward without interference from seal flaps 112 and 114, and to deflate first and second grind seals 148 and 150 to allow unencumbered movement of bridge element 56.

Process 340 continues with a task 350. At task 350, second workpiece 72 is placed on left spindle 30 (FIG. 9). Again, second workpiece 72 may be a single wafer, a bonded wafer pair, or any of a variety of different types and configurations of workpieces. Second workpiece 72 may be placed on left spindle 30 using, for example, a conventional automated robot, and control system 170 communicates the appropriate control signals to translate bridge element 56 and control right and left seal flaps 112 and 114 (FIG. 8). The loading and unloading operations described herein are discussed in connection with a serial procession of the tasks for simplicity. Those skilled in the art will recognize that certain loading operations may be performed concurrent with certain unloading operations in accordance with the standard operation of apparatus 100.

Following trimming task 350, a control task 352 is performed. At task 352, bridge element 56 is translated to one of second and fourth edge trimming positions 258 and 266 (FIGS. 15 and 16), the appropriate right and left seal flaps 112 and 114 are adjusted to allow translation of bridge element 56, both of right and left grind seals 148 and 150 (FIG. 11) are inflated in accordance with table 306 (FIG. 19), and so forth.

Process 340 continues with a task 354. At task 354, edge trimming is performed on second workpiece 72 using either of right and left grinding wheels 46 and 48, in accordance with the selected one of second and fourth edge trimming positions 258 and 266. During edge trimming, both right and left grind seals 148 and 150 are inflated and one or both of right and left seal flaps 112 and 114 is in down position 134 (FIG. 8) to contain water and grinding effluent. Thus, following tasks 346 and 354, first outer edge 258 (FIG. 15) of first workpiece 70 and second outer edge 260 (FIG. 15) of second workpiece 72 are trimmed to a stepped edge, such as that shown in FIGS. 6 and 7, to limit the probability of chipping at edges 258 and 260 and/or to remove rough or damaged surfaces from the edge region of first and second workpieces 70 and 72.

Following task 354, a task 356 is performed. At task 356, second workpiece 72 is unloaded from left spindle 30. In order to unload second workpiece 72 at task 356, signaling will be initiated at control system 170 (FIG. 13) in order to translate bridge element 56 for workpiece unloading, to adjust first and second seal flaps 112 and 114 so that bridge element 56 can move rightward or leftward without interference from seal flaps 112 and 114, and to deflate first and second grind seals 148 and 150 to allow unencumbered movement of bridge element 56.

Next, workpiece conditioning process 340 continues with a query task 358. At query task 358, a determination is made as to whether there are additional workpieces calling for edge trimming. For example, apparatus 100 may be processing workpieces in a batch mode where a multiplicity of workpieces is to undergo edge trimming. These additional workpieces may be loaded into cassettes, whereby apparatus 100 recognizes their presence so as to continue edge trimming. Alternatively, apparatus 100 may be programmed or otherwise configured to perform edge trimming on a predetermined number of workpieces. When a determination is made at query task 358 that there are additional workpieces calling for edge trimming, program control loops back to task 342 such that loading, control, edge trimming, and unloading operations can be performed for the additional workpieces. However, when a determination is made at query task 358 that edge trimming is to be discontinued, program control continues with a task 360.

Continued execution of workpiece conditioning process 340 presumes that the workpieces are to now undergo surface grinding. Accordingly, first and second workpieces 70 and 72 are placed on respective first and second spindles 28 and 30 at task 360.

Process 340 continues with a task 362 at which a conventional two-step surface grinding process may be performed on first and second workpieces 70 and 72, as discussed above in connection with FIG. 3, to grind the surfaces of each of first and second workpieces 70 and 72. Following task 362, first and second workpieces 70 and 72 are appropriately processed in which both edge trimming and surface grinding have been performed.

Following task 362, a task 364 is performed. At task 364, first workpiece 70 is unloaded from right spindle 28 and second workpiece 72 is unloaded from left spindle 30. In order to unload first and second workpieces 70 and 72 at task 364, suitable signaling will be initiated at control system 170 (FIG. 13) in order to translate bridge element 56 for workpiece unloading, to adjust first and second seal flaps 112 and 114 so that bridge element 56 can move rightward or leftward without interference from seal flaps 112 and 114, and to deflate first and second grind seals 148 and 150 to allow unencumbered movement of bridge element 56.

Following task 364, a query task 366 is performed. At query task 366, a determination is made as to whether there are additional workpieces calling for surface grinding. For example, apparatus 100 may be processing workpieces in a batch mode where a multiplicity of workpieces is to undergo surface grinding. When a determination is made at query task 366 that there are additional workpieces calling for surface grinding, program control loops back to task 360 such that loading, surface grinding, and unloading operations can be performed for the additional workpieces. However, when a determination is made at query task 366 that surface grinding is to be discontinued, process 340 exits.

In summary, an embodiment entails an apparatus for concurrently processing two workpieces (i.e., wafers), in which the apparatus can perform both surface grinding and edge trimming operations. Another embodiment entails a system for enabling a surface grinding apparatus to perform edge trimming, and still another embodiment entails a method for concurrently processing two workpieces using a surface grinding apparatus adapted to additionally perform edge trimming. Advantages of the disclosed embodiments include lower capital equipment costs, less manufacturing facility space requirements, fewer process consumables, and so forth.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An apparatus for processing a first workpiece and a second workpiece comprising:

a first spindle configured to hold said first workpiece;

a second spindle configured to hold said second workpiece;

a bridge element laterally movable relative to said first and second spindles;

a first grinding wheel coupled to said bridge element;

a second grinding wheel coupled to said bridge element, and laterally displaced from said first grinding wheel;

a controller in communication with said bridge element, said controller directing said bridge element to move laterally relative to said first and second spindles such that at least one of said first and second grinding wheels overlies at least one of a first surface of said first workpiece and a second surface of said second workpiece to condition said at least one of said first and second surfaces, and said controller further directing said bridge element to move laterally relative to said first and second spindles such that said first grinding wheel overlies an outer edge of said first workpiece to trim said outer edge of said first workpiece and said second grinding wheel is laterally displaced out of contact with said second workpiece;

a seal flap coupled to an edge of said bridge element; and a seal flap control element in communication with said seal flap for controlling a position of said seal flap in response to a bridge position of said bridge element, said position being one of an up position and a down position, wherein said seal flap is placed in said up position when said bridge element is directed to move laterally, and said seal flap is placed in said down position when said outer edge of said first workpiece is being trimmed.

2. An apparatus as claimed in claim 1 further comprising a grind chamber in which both of said first and second spindles are positioned.

3. An apparatus as claimed in claim 2 further comprising:

a mounting plate coupled to a top of said grind chamber, said mounting plate including a mounting section overlying said grind chamber; and a grind seal system installed in said mounting section and encircling a top opening of said grind chamber.

4. An apparatus as claimed in claim 3 wherein said grind seal system comprises:

a first substantially linear grind seal having a first end and a second end; and a second substantially linear grind seal having a third end and a fourth end, each of said first and second grind seals being flexible so as to fit into said mounting section with said first end abutting said third end, and said second end abutting said fourth end to form a substantially curvilinear shape encircling said top opening of said grind chamber.

5. An apparatus as claimed in claim 4 wherein each of said first and second grind seals is inflatable, and said apparatus further comprises a grind seal control element for selectively directing said first and second grind seals to inflate and deflate in response to a position of said bridge element.

6. An apparatus as claimed in claim 1 wherein said outer edge is a first outer edge, said controller directs said bridge element to move laterally to position said first and second grinding wheels into multiple edge trimming positions between said first and second spindles, said edge trimming positions including:

a first position in which said first grinding wheel overlies said first outer edge of said first workpiece to trim said first outer edge, and said second grinding wheel is laterally displaced out of contact with said first and second workpieces;

a second position in which said first grinding wheel overlies a second outer edge of said second workpiece to trim said second outer edge, and said second grinding wheel is laterally displaced out of contact with said first and second workpieces;

a third position in which said second grinding wheel overlies said first outer edge of said first workpiece to trim said first outer edge, and said first grinding wheel is laterally displaced out of contact with said first and second workpieces; and a fourth position in which said second grinding wheel overlies said second outer edge of said second workpiece to trim said second outer edge, and said first grinding wheel is laterally displaced out of contact with said first and second workpieces.

7. An apparatus as claimed in claim 1 wherein said seal flap is a first seal flap, said outer edge is a first edge, and said apparatus further comprises a second seal flap coupled to a second edge of said bridge element, wherein said seal flap control element is additionally in communication with said second seal flap for controlling said position of said second seal flap in one of said up position and said down position.

8. An apparatus as claimed in claim 1 wherein:

a first center of said first spindle is separated by a first distance from a second center of said second spindle, said first distance being greater than fifteen inches;

said first grinding wheel is configured to rotate about a first axis; and said second grinding wheel is configured to rotate about a second axis, said second axis being aligned substantially parallel to said first axis, and said first and second axes being separated by a second distance that is greater than fifteen inches.

9. An apparatus as claimed in claim 1 wherein said first and second grinding wheels are laterally immovable relative to one another.

10. An apparatus for processing a first workpiece and a second workpiece comprising:

a first spindle configured to hold said first workpiece;

a second spindle configured to hold said second workpiece;

a bridge element laterally movable relative to said first and second spindles;

a first grinding wheel coupled to said bridge element;

a second grinding wheel coupled to said bridge element, and laterally displaced from said first grinding wheel;

a controller in communication with said bridge element, said controller directing said bridge element to move laterally relative to said first and second spindles such that at least one of said first and second grinding wheels overlies at least one of a first surface of said first workpiece and a second surface of said second workpiece to condition said at least one of said first and second surfaces, and said controller further directing said bridge element to move laterally relative to said first and second spindles such that said first grinding wheel overlies an outer edge of said first workpiece to trim said outer edge of said first workpiece and said second grinding wheel is laterally displaced out of contact with said second workpiece;

wherein said outer edge is a first outer edge, said controller directs said bridge element to move laterally to position said first and second grinding wheels into multiple edge trimming positions between said first and second spindles, said edge trimming positions including:

a first position in which said first grinding wheel overlies said first outer edge of said first workpiece to trim said first outer edge, and said second grinding wheel is laterally displaced out of contact with said first and second workpieces;

a second position in which said first grinding wheel overlies a second outer edge of said second workpiece to trim said second outer edge, and said second grinding wheel is laterally displaced out of contact with said first and second workpieces;

a third position in which said second grinding wheel overlies said first outer edge of said first workpiece to trim said first outer edge, and said first grinding wheel is laterally displaced out of contact with said first and second workpieces; and a fourth position in which said second grinding wheel overlies said second outer edge of said second workpiece to trim said second outer edge, and said first grinding wheel is laterally displaced out of contact with said first and second workpieces.

11. A system for enabling a surface grinding apparatus to additionally perform edge trimming, said surface grinding apparatus including a first spindle configured to hold a first workpiece, a second spindle configured to hold a second workpiece, a bridge element laterally movable relative to said first and second spindles, first and second grinding wheels coupled to said bridge element, said first and second grinding wheels being laterally immovable relative to one another, and said system comprising:

a grind chamber sized to accommodate both of said first and second spindles;

a mounting plate coupled to a top of said grind chamber, said mounting plate including a mounting section overlying said grind chamber;

a grind seal system including a first substantially linear grind seal and a second substantially linear grind seal, said first grind seal having a first end and a second end, said second grind seal having a third end and a fourth end, each of said first and second grind seals being flexible so as to fit into said mounting section with said first end abutting said third end, and said second end abutting said fourth end to form a substantially curvilinear shape encircling a top opening of said grind chamber, each of said first and second grind seals being inflatable;

an edge trimming controller in communication with said grind seal system, said edge trimming controller including a grind seal control element for selectively directing said first and second grind seals to inflate and deflate in response to a position of said bridge element;

wherein said bridge element is enabled to position said first and second grinding wheels into multiple edge trimming positions between said first and second spindles, said edge trimming positions including:

a first position in which said first grinding wheel overlies a first outer edge of said first workpiece to trim said first outer edge, and said second grinding wheel is laterally displaced out of contact with said first and second workpieces;

a second position in which said first grinding wheel overlies a second outer edge of said second workpiece to trim said second outer edge, and said second grinding wheel is laterally displaced out of contact with said first and second workpieces;

a third position in which said second grinding wheel overlies said first outer edge of said first workpiece to trim said first outer edge, and said first grinding wheel is laterally displaced out of contact with said first and second workpieces; and a fourth position in which said second grinding wheel overlies said second outer edge of said second workpiece to trim said second outer edge, and said first grinding wheel is laterally displaced out of contact with said first and second workpieces.

12. A system as claimed in claim 11 wherein said surface grinding apparatus further includes a controller for initiating a first grind seal control signal to said first grind seal and a second grind seal control signal to said second grind seal, and said grind seal control element is configured to intercept and selectively override said first and second grind seal control signals in response to said position of said bridge element.

13. A system as claimed in claim 12 further comprising:

a track; and at least one sensor configured for attachment to said track, said sensor detecting when said bridge moves to an edge trim position and communicating an edge trim signal to said grind seal control element of said edge trim controller in response to said edge trim position, and said grind seal control element ensures that both of said first and second grind seals are inflated in response to said edge trim position.

14. A system as claimed in claim 11 further comprising:

a first seal flap configured for attachment to a first edge of said bridge element;

a second seal flap configured for attachment to a second edge of said bridge element; and said edge trimming controller further includes a seal flap control element in communication with said first and second flap for controlling a position of each of said first and second seal flaps in response to said position of said bridge element, said position being one of an up position and a down position.

15. A system for enabling a surface grinding apparatus to additionally perform edge trimming, said surface grinding apparatus including a first spindle configured to hold a first workpiece, a second spindle configured to hold a second workpiece, a bridge element laterally movable relative to said first and second spindles, first and second grinding wheels coupled to said bridge element, said first and second grinding wheels being laterally immovable relative to one another, and said system comprising:

a grind chamber sized to accommodate both of said first and second spindles;

a mounting plate coupled to a top of said grind chamber, said mounting plate including a mounting section overlying said grind chamber;

a grind seal system including a first substantially linear grind seal and a second substantially linear grind seal, said first grind seal having a first end and a second end, said second grind seal having a third end and a fourth end, each of said first and second grind seals being flexible so as to fit into said mounting section with said first end abutting said third end, and said second end abutting said fourth end to form a substantially curvilinear shape encircling a top opening of said grind chamber, each of said first and second grind seals being inflatable; and a first seal flap configured for attachment to a first edge of said bridge element;

a second seal flap configured for attachment to a second edge of said bridge element; and an edge trimming controller in communication with said grind seal system, said edge trimming controller including a grind seal control element for selectively directing said first and second grind seals to inflate and deflate in response to a position of said bridge element, and said edge trimming controller further including a seal flap control element in communication with said first and second seal flap for controlling a position of each of said first and second seal flaps in response to said position of said bridge element, said position being one of an up position and a down position.

16. A system as claimed in claim 14 wherein said surface grinding apparatus includes a track to which said bridge element is movably mounted, and said system further comprises a sensor configured for attachment to said track, said sensor sensing when said bridge moves to an edge trim position and communicating an edge trim signal to said seal flap control element of said edge trim controller in response to said edge trim position, and said seal flap control element ensures that said one of said first and second seal flaps interposed between said first and second spindles is moved to an up position in response to said edge trim signal.

17. A method for processing a first workpiece and a second workpiece using a surface grinding apparatus adapted to additionally perform edge trimming, said apparatus including a first spindle and a second spindle, a bridge element laterally movable relative to said first and second spindles, first and second grinding wheels coupled to said bridge element, a seal flap coupled to an edge of said bridge element, said seal flap being controllable between an up position and a down position, and said method comprising:

placing said first workpiece on said first spindle, said first workpiece having a first outer edge;

placing said second workpiece on said second spindle, said second workpiece having a second outer edge;

translating said bridge element to position one of said first and second grinding wheels between said first and second spindles in an edge trimming position such that said one of said first and second grinding wheels overlies one of said first and second outer edges another of said first and second grinding wheels is laterally displaced out of contact with said first and second workpieces, and said seal flap is adjusted to said up position during said translating operation;

removing said one of said first and second outer edges with said one of said first and second grinding wheels, and adjusting said seal flap to said down position during said down position; and repeating said translating and removing operations to remove another of said first and second outer edges from another of said first and second workpieces.

18. A method as claimed in claim 17 wherein said apparatus further includes a grind chamber in which both of said first and second spindles are positioned, a mounting plate coupled to a top of said grind chamber, and an inflatable grind seal system installed in a mounting section of said mounting plate, said grind seal system including a first grind seal and a second grind seal fitting into said mounting section to form a substantially curvilinear shape encircling a top opening of said grind chamber, and said method further comprises inflating said first and second grind seals when said bridge element is in said edge trimming position.

19. A method as claimed in claim 17 further comprising selecting said edge trimming position from multiple edge trimming positions, said multiple edge trimming positions including:

a first position in which said first grinding wheel overlies said first outer edge of said first workpiece for trimming said first outer edge, and said second grinding wheel is laterally displaced out of contact with said first and second workpieces;

a second position in which said first grinding wheel overlies a second outer edge of said second workpiece for trimming said second outer edge, and said second grinding wheel is laterally displaced out of contact with said first and second workpieces;

a third position in which said second grinding wheel overlies said first outer edge of said first workpiece for trimming said first outer edge, and said first grinding wheel is laterally displaced out of contact with said first and second workpieces; and a fourth position in which said second grinding wheel overlies said second outer edge of said second workpiece for trimming said second outer edge, and said first grinding wheel is laterally displaced out of contact with said first and second workpieces.

20. A method for processing a first workpiece and a second workpiece using a surface grinding apparatus adapted to additionally perform edge trimming, said apparatus including a first spindle and a second spindle, a bridge element laterally movable relative to said first and second spindles, first and second grinding wheels coupled to said bridge element, and said method comprising:

placing said first workpiece on said first spindle, said first workpiece having a first outer edge;

placing said second workpiece on said second spindle, said second workpiece having a second outer edge;

translating said bridge element to position one of said first and second grinding wheels between said first and second spindles in an edge trimming position selected from multiple edge trimming positions such that said one of said first and second grinding wheels overlies one of said first and second outer edges, and another of said first and second grinding wheels is laterally displaced out of contact with said first and second workpieces;

removing said one of said first and second outer edges with said one of said first and second grinding wheels; and repeating said translating and removing operations to remove another of said first and second outer edges from another of said first and second workpieces wherein said multiple edge trimming positions include:

a first position in which said first grinding wheel overlies said first outer edge of said first workpiece for trimming said first outer edge, and said second grinding wheel is laterally displaced out of contact with said first and second workpieces;

a second position in which said first grinding wheel overlies a second outer edge of said second workpiece for trimming said second outer edge, and said second grinding wheel is laterally displaced out of contact with said first and second workpieces;

a third position in which said second grinding wheel overlies said first outer edge of said first workpiece for trimming said first outer edge, and said first grinding wheel is laterally displaced out of contact with said first and second workpieces; and a fourth position in which said second grinding wheel overlies said second outer edge of said second workpiece for trimming said second outer edge, and said first grinding wheel is laterally displaced out of contact with said first and second workpieces.

* * * * *